US009182740B2

(12) United States Patent
Shimizu

(10) Patent No.: US 9,182,740 B2
(45) Date of Patent: Nov. 10, 2015

(54) CARTRIDGE HAVING PHOTOSENSITIVE BODY CARTRIDGE AND DEVELOPER CARTRIDGE

(71) Applicant: Keita Shimizu, Tsushima (JP)

(72) Inventor: Keita Shimizu, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 15 days.

(21) Appl. No.: 14/226,935

(22) Filed: Mar. 27, 2014

(65) Prior Publication Data

US 2014/0294403 A1 Oct. 2, 2014

(30) Foreign Application Priority Data

Mar. 27, 2013 (JP) ..... 2013-067071

(51) Int. Cl.
*G03G 15/00* (2006.01)
*G03G 21/18* (2006.01)
*G03G 21/16* (2006.01)

(52) U.S. Cl.
CPC ..... *G03G 21/1857* (2013.01); *G03G 21/1647* (2013.01); *G03G 2221/1892* (2013.01)

(58) Field of Classification Search
CPC ..... G03G 21/1892; G03G 21/1857; G03G 21/1817; G03G 21/1647; G03G 2221/1892
USPC ..... 399/12, 13, 24, 25, 26
See application file for complete search history.

(56) References Cited

U.S. PATENT DOCUMENTS

| | | | | |
|---|---|---|---|---|
| 6,298,202 | B1 | 10/2001 | Fushiya et al. | |
| 8,009,996 | B2 * | 8/2011 | Ishikawa | 399/12 |
| 2006/0193646 | A1 * | 8/2006 | Suzuki et al. | 399/12 |
| 2008/0205911 | A1 * | 8/2008 | Ishikawa et al. | 399/12 |
| 2013/0051814 | A1 * | 2/2013 | Itabashi et al. | 399/12 |
| 2013/0136460 | A1 * | 5/2013 | Shiraki et al. | 399/12 |

FOREIGN PATENT DOCUMENTS

| | | | |
|---|---|---|---|
| JP | 2001-222204 | A | 8/2001 |
| JP | 2011-203493 | A | 10/2011 |

* cited by examiner

*Primary Examiner* — Billy Lactaoen
(74) *Attorney, Agent, or Firm* — Banner & Witcoff, Ltd.

(57) ABSTRACT

A developer cartridge includes: a first rotary body having at least one detected part; and a second rotary body. The first rotary body is configured to rotate between a first position, in which a transmission part is disposed opposite the second rotary body, and a second position, in which a non-transmission part is disposed opposite the second rotary body. The first rotary body includes a contacted part. A photosensitive body cartridge includes a moving member. When the moving member is in a third position, the moving member contacts the contacted part of the first rotary body disposed in the second position, causing the first rotary body to rotate to the first position. Thereafter, in association with rotation of the first rotary body, the moving member moves to a fourth position, in which the moving member is unable to contact the contacted part.

19 Claims, 20 Drawing Sheets

CARTRIDGE HAVING PHOTOSENSITIVE BODY CARTRIDGE AND DEVELOPER CARTRIDGE

CROSS REFERENCE TO RELATED APPLICATION

This application claims priority from Japanese Patent Application No. 2013-067071 filed Mar. 27, 2013. The entire content of this priority application is incorporated herein by reference.

TECHNICAL FIELD

The present invention relates to a cartridge having a photosensitive body cartridge and a developer cartridge attachable to and detachable from the photosensitive body cartridge.

BACKGROUND

There is conventionally known such a cartridge that is mounted in an image forming apparatus and that has a photosensitive body cartridge and a developer cartridge. The photosensitive body cartridge is provided with a photosensitive body, while the developer cartridge accommodates developer therein. The photosensitive body cartridge and the developer cartridge can be changed with new cartridges individually from each other.

The conventional developer cartridge has a sensor gear that rotates irreversibly when receiving input of a drive force from the main body of the image forming apparatus. The sensor gear is provided with a contact projection. An actuator is provided in the main body of the image forming apparatus. Depending on whether the contact projection contacts the actuator, the image forming apparatus can detect whether the developer cartridge is in a new state.

SUMMARY

Because the photosensitive body cartridge and the developer cartridge can be changed with new cartridges individually from each other, it is desirable that the image forming apparatus be provided with not only the mechanism for detecting whether the developer cartridge is in a new state but also a mechanism for detecting whether the photosensitive body cartridge is in a new state. It is therefore conceivable that the image forming apparatus be provided with not only the actuator for detecting whether the developer cartridge is in a new state but also an additional actuator for detecting whether the photosensitive body cartridge is in a new state. In such a case, however, the number of parts provided in the image forming apparatus will increase.

In view of the foregoing, it is an object of the invention to provide a cartridge that includes a photosensitive body cartridge and a developer cartridge and that enables detection of whether the photosensitive body cartridge is new and whether the developer cartridge is new, while restraining increase in the number of parts required for the detection.

In order to attain the above and other objects, the invention provides a cartridge including: a photosensitive body cartridge having a photosensitive body; and a developer cartridge configured to accommodate developer therein and configured so as to be attachable to and detachable from the photosensitive body cartridge. The developer cartridge includes: a first rotary body; and a second rotary body. The first rotary body is rotatably supported by the developer cartridge and has at least one detected part configured to be detected by a detecting unit that is provided outside the cartridge. The second rotary body is rotatably supported by the developer cartridge and is configured to transmit, to the first rotary body, drive force inputted from an outside of the cartridge. The first rotary body includes: a transmission part; and a non-transmission part. The transmission part is configured such that when the transmission part is disposed opposite the second rotary body, the transmission part brings the first rotary body into a state that the first rotary body is able to receive drive force from the second rotary body, thereby causing the first rotary body to rotate. The non-transmission part is configured such that when the non-transmission part is disposed opposite the second rotary body, the non-transmission part brings the first rotary body into a state that the first rotary body is unable to receive drive force from the second rotary body. The first rotary body is configured to rotate between a first position, in which the transmission part is disposed opposite the second rotary body, and a second position, in which the non-transmission part is disposed opposite the second rotary body. The first rotary body reaches the second position after having rotated by a prescribed amount from the first position. The first rotary body including a contacted part. The photosensitive body cartridge includes a moving member configured to move between a third position, in which the moving member is able to contact the contacted part, and a fourth position, in which the moving member is unable to contact the contacted part. The moving member is configured such that when the moving member is in the third position, the moving member contacts the contacted part of the first rotary body disposed in the second position, causing the first rotary body to rotate to the first position, and the moving member thereafter moves to the fourth position in association with rotation of the first rotary body.

According to another aspect, the invention provides a drum cartridge for detachably accommodating a developer cartridge therein, the developer cartridge including a drive-force input member configured to receive drive force from an outside of the developer cartridge and a detected body configured to be detected by an external detecting device that is provided outside the developer cartridge, the detected body being configured to rotate about a prescribed rotational axis upon receipt of drive force transmitted from the drive-force input member. The drum cartridge includes: a photosensitive drum; a housing; and a moving member. The housing is configured to detachably accommodate a developer cartridge therein. The moving member is configured to move relative to the housing. The moving member is configured to move the detected body to a first position, in which drive force is transmitted from the drive-force input member to the detected body, from a second position, in which transmission of drive force from the drive-force input member to the detected body is blocked, by contacting the detected body disposed in the second position.

According to still another aspect, the invention provides a process cartridge including: a developer cartridge; and a drum cartridge having a photosensitive drum and a housing configured to detachably accommodate the developer cartridge therein. The developer cartridge includes: a drive-force input member; a detected body; and a developing roller. The drive-force input member is configured to receive drive force from an outside of the process cartridge. The detected body is configured to be detected by an external detecting device that is provided outside the process cartridge. The detected body is configured to move between a first position, in which drive force is transmitted from the drive-force input member to the detected body, and a second position, in which transmission of drive force from the drive-force input member to the detected body is blocked. The detected body is configured to rotate about a prescribed rotational axis upon receipt of drive force transmitted from the drive-force input member. The developing roller is configured to supply developer to the photosensitive drum. The drum cartridge includes a moving member configured to move relative to the housing, the moving member being positioned within a rotating path of the detected body, the moving member being configured to contact the detected body in the second position, to thereby move the detected body from the second position to the first position.

BRIEF DESCRIPTION OF THE DRAWINGS

The particular features and advantages of the invention as well as other objects will become apparent from the following description taken in connection with the accompanying drawings, in which.

DETAILED DESCRIPTION

First Embodiment

Figure 1:
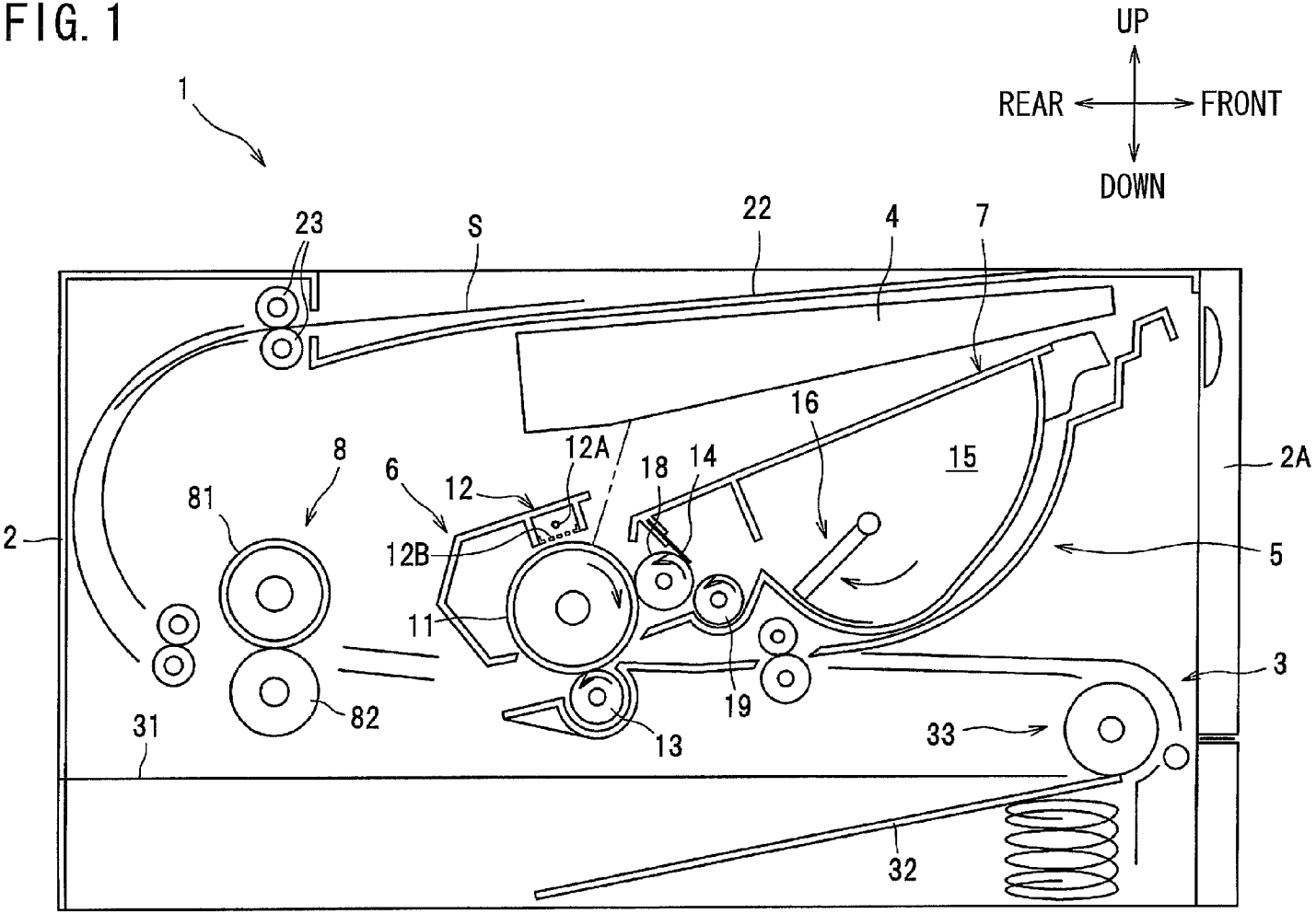
FIG. 1 schematically shows the configuration of a laser printer provided with a process cartridge according to a first embodiment of the present invention.

Next, a first embodiment of the present invention will be described in detail while referring to the accompanying drawings. First, the general structure of a laser printer 1 provided with a process cartridge 5 (as an example of a cartridge) according to the first embodiment will be described. Then, a detailed description will be given of the specific feature of the process cartridge 5.

Directions given in the following description will be based on the perspective of a user operating the laser printer 1. Specifically, the right side in the drawing of FIG. 1 will be considered the "front side" of the laser printer 1, the left side in the drawing of FIG. 1 the "rear side" of the laser printer 1, the near side in the drawing of FIG. 1 the "left side" of the laser printer 1, and the far side in the drawing of FIG. 1 the "right side" of the laser printer 1. Further, the "top" and "bottom" in the drawing of FIG. 1 will be considered the "top" and "bottom" of the laser printer 1.

General Structure of the Laser Printer

As shown in FIG. 1, the laser printer 1 includes a main casing 2, a sheet-feeding unit 3 for supplying sheets S of paper to be printed, an exposure unit 4, a process cartridge 5 for transferring toner images onto the sheets S, and a fixing unit 8 for fixing the toner images on the sheets S with heat.

The sheet-feeding unit 3 is provided in the bottom section of the main casing 2 and primarily includes a paper tray 31 accommodating the sheets S, a paper-pressing plate 32, and a paper-feeding mechanism 33. The paper-pressing plate 32 urges upward the sheets S accommodated in the paper tray 31, and the paper-feeding mechanism 33 supplies the sheets S from the paper tray 31 to the process cartridge 5 (a position between a photosensitive drum 11 and a transfer roller 13).

The exposure unit 4 is disposed in the top section of the main casing 2 and includes a laser light source, a polygon mirror, lenses, reflecting mirrors, and the like (not shown). With the exposure unit 4, a laser beam (indicated by a chain line in FIG. 1) is emitted from the laser light source based on image data, and is scanned over the surface of the photosensitive drum 11 at a high speed, whereby the surface of the photosensitive drum 11 is exposed to the laser beam.

The process cartridge 5 is disposed below the exposure unit 4. A front cover 2A provided to the main casing 2 can be opened to expose an opening through which the process cartridge 5 can be mounted in or removed from the main casing 2. The process cartridge 5 is configured of a drum cartridge 6 (as an example of a photosensitive body cartridge), and a developer cartridge 7 (as an example of a developer cartridge).

The drum cartridge 6 is primarily configured of the photosensitive drum 11 (as an example of a photosensitive body), a charger 12, and a transfer roller 13.

The charger 12 is a Scorotron charger provided with a discharge wire 12A and a grid electrode 12B, and is disposed opposite the photosensitive drum 11. By being supplied with electric power from a power supply (not shown), the charger 12 generates a corona discharge and charges the photosensitive drum 11 uniformly.

The developer cartridge 7 is attachable to and detachable from the drum cartridge 6. The process cartridge 5 having the developer cartridge 7 attached to the drum cartridge 6 is removably mountable to the main casing 2. The developer cartridge 7 is primarily configured of a developing roller 18, a supply roller 19, a thickness-regulating blade 14, a toner-accommodating section 15 configured to accommodate toner (as an example of developer) therein, and an agitator 16.

With the process cartridge 5 having this construction, first the charger 12 applies a uniform charge to the surface of the photosensitive drum 11, and the charged surface is subsequently exposed to a laser beam emitted from the exposure unit 4 and scanned at a high speed over the charged surface, forming an electrostatic latent image on the surface of the photosensitive drum 11 based on image data. In the meantime, as the agitator 16 agitates toner inside the toner-accommodating section 15, some of the toner is supplied onto the supply roller 19, which in turn supplies the toner onto the developing roller 18. As the developing roller 18 continues to rotate, toner supplied to the surface thereof enters between the developing roller 18 and the thickness-regulating blade 14, and the thickness-regulating blade 14 regulates the toner carried on the developing roller 18 to a thin layer of a uniform thickness.

Toner carried on the surface of the developing roller 18 is supplied to the electrostatic latent image formed on the surface of the photosensitive drum 11, thereby developing the latent image into a visible toner image. This toner image is subsequently transferred onto a sheet S as the sheet S passes between the photosensitive drum 11 and transfer roller 13.

The fixing unit 8 is disposed on the rear side of the process cartridge 5. The fixing unit 8 primarily includes a heating roller 81, and a pressure roller 82 applying pressure to the heating roller 81. The fixing unit 8 having this construction thermally fixes toner images to sheets S after the transfer operation as the sheets S pass between the heating roller 81 and pressure roller 82. After the toner image is fixed to a sheet S, discharge rollers 23 discharge the sheet S into a discharge tray 22.

Detailed Description of the Process Cartridge

Next, the structure of the process cartridge 5 will be described. In the following description, a "new state" will refer to the state of the process cartridge 5 at shipping, i.e., the state of a new product, and a "used state" will refer to the state of the process cartridge 5 after the process cartridge 5 has been mounted in the main casing 2 and used at least once.

Figure 2A:
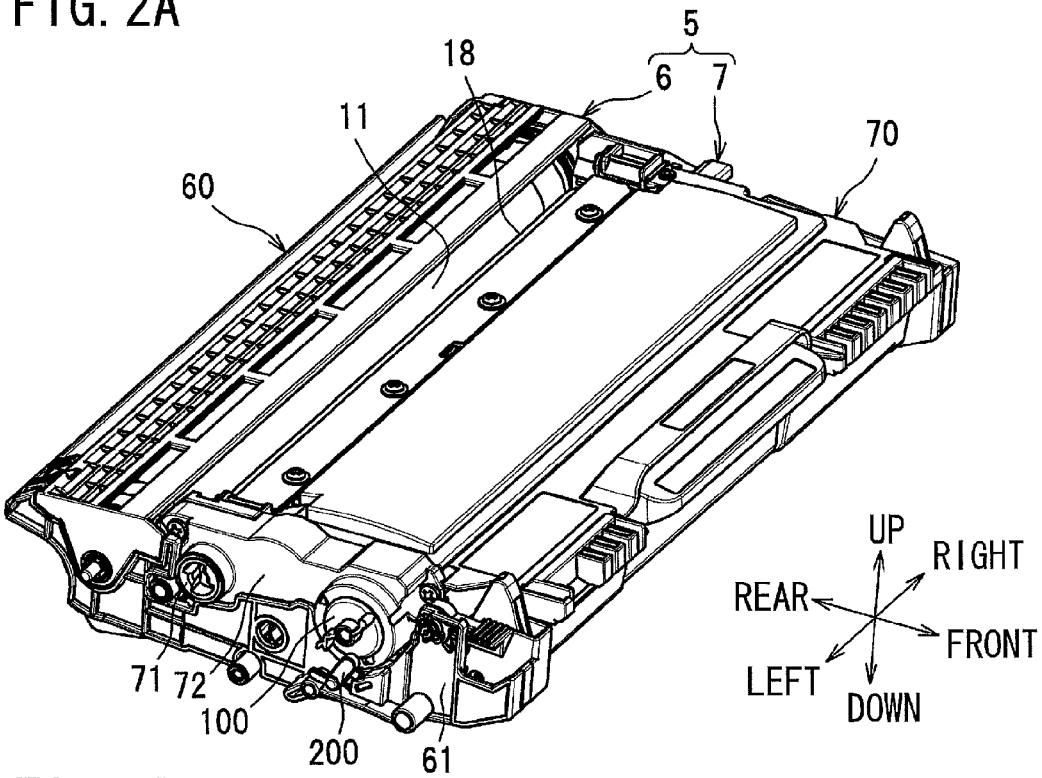
FIG. 2A is a perspective view of the process cartridge shown in FIG. 1.

As shown in FIG. 2A, the process cartridge 5 includes a sensor gear 100 (as an example of a first rotary body and as an example of a detected body), and a pivoting member 200. The sensor gear 100 is provided on the developer cartridge 7. The pivoting member 200 is provided on the drum cartridge 6. The sensor gear 100 and the pivoting member 200 are used to detect whether the drum cartridge 6 and developer cartridge 7 are new.

The developer cartridge 7 includes a developer-cartridge frame 70 that supports the developing roller 18 and the like. The sensor gear 100, an input gear 71 (as an example of a drive-force input member), and a plurality of other gears (not shown) are rotatably provided on the left side wall of the developer-cartridge frame 70. A cover 72 is attached to the developer-cartridge frame 70 for covering these gears. While not indicated with reference numerals in the drawings, openings are formed in the cover 72 at positions corresponding to the input gear 71 and sensor gear 100. Thus, the left side surfaces of the input gear 71 and sensor gear 100 are exposed through the openings in the cover 72.

The drum cartridge 6 includes a drum-cartridge frame 60 (as an example of a casing and as an example of a housing) that supports the photosensitive drum 11 and the like. The pivoting member 200 is pivotably provided on a left side wall 61 of the drum-cartridge frame 60.

Figure 2B:
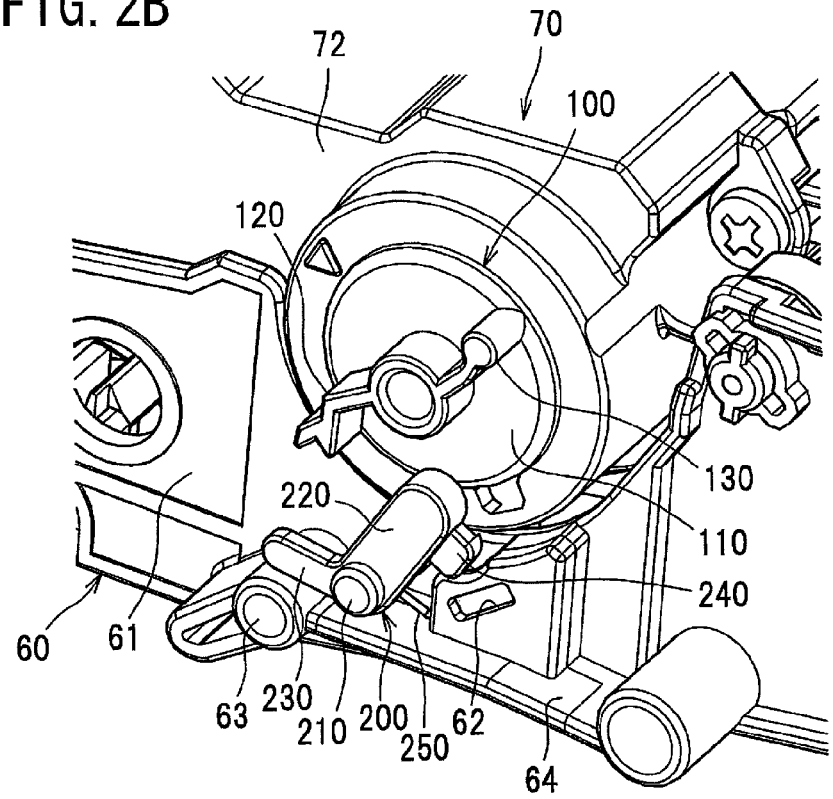
FIG. 2B is an enlarged view of a portion of the process cartridge around a sensor gear.

As shown in FIG. 2B, the sensor gear 100 has a disc-shaped body part 110 that is rotatably supported on the developer-cartridge frame 70, and a first detection part 120 and a second detection part 130 (as an example of a detected part and as an example of a detected body) that can be detected by a sensing mechanism 300 described later.

The first detection part 120 (as an example of a contact part) is a rib-like protrusion that projects outward (leftward in a direction following the rotational axis of the sensor gear 100) from the surface of the body part 110 exposed through the cover 72. The first detection part 120 extends radially outward from the rotational center of the body part 110.

The second detection part 130 (as an example of a contacted part) is also a rib-like protrusion that projects outward (leftward) from the surface of the body part 110 exposed through the cover 72. The second detection part 130 extends radially outward from the rotational center of the body part 110 in the direction opposite from the first detection part 120. The distal end of the second detection part 130 is rounded.

The first detection part 120 extends further outward in a radial direction of the body part 110 than the second detection part 130. That is, the distal end of the first detection part 120 is positioned farther from the rotational center of the body part 110 than the distal end of the second detection part 130.

The pivoting member 200 is disposed beneath the sensor gear 100. The pivoting member 200 is configured of a shaft part 210 pivotably supported in the left side wall 61 of the drum-cartridge frame 60, and a first arm 220 and a second arm 230 that extend from the shaft part 210 in a general L-shape.

The first arm 220 (as an example of a moving member) extends diagonally upward and forward from the shaft part 210. By pivoting the pivoting member 200 relative to the drum-cartridge frame 60, the first arm 220 can be moved between a contact position (as an example of a third position) shown in FIG. 2B, for example, in which the first arm 220 can contact the second detection part 130, and a non-contact position (as an example of a fourth position) shown in FIG. 5C, for example, in which the first arm 220 cannot contact the second detection part 130.

That is, when the first arm 220 is in the contact position, the distal end of the first arm 220 is positioned within the rotational paths of the first and second detection parts 120 and 130 and faces downstream in the rotational direction of the sensor gear 100. When the first arm 220 is in the non-contact position pivoted clockwise in FIG. 2B from the contact position, an entire part of the first arm 220 is positioned outside the rotational paths of the first and second detection parts 120 and 130 (see FIG. 5C).

A boss 63 protrudes from the left side wall 61 of the drum-cartridge frame 60. When the first arm 220 is in the contact position, the second arm 230 extends rearward from the shaft part 210. In this state, the second arm 230 can contact the boss 63 on the top thereof.

The pivoting member 200 also has an engaging part 240. The engaging part 240 is formed on the first arm 220 so as to protrude in the same direction that the first arm 220 proceeds when moving from the contact position to the non-contact position.

Figure 3:
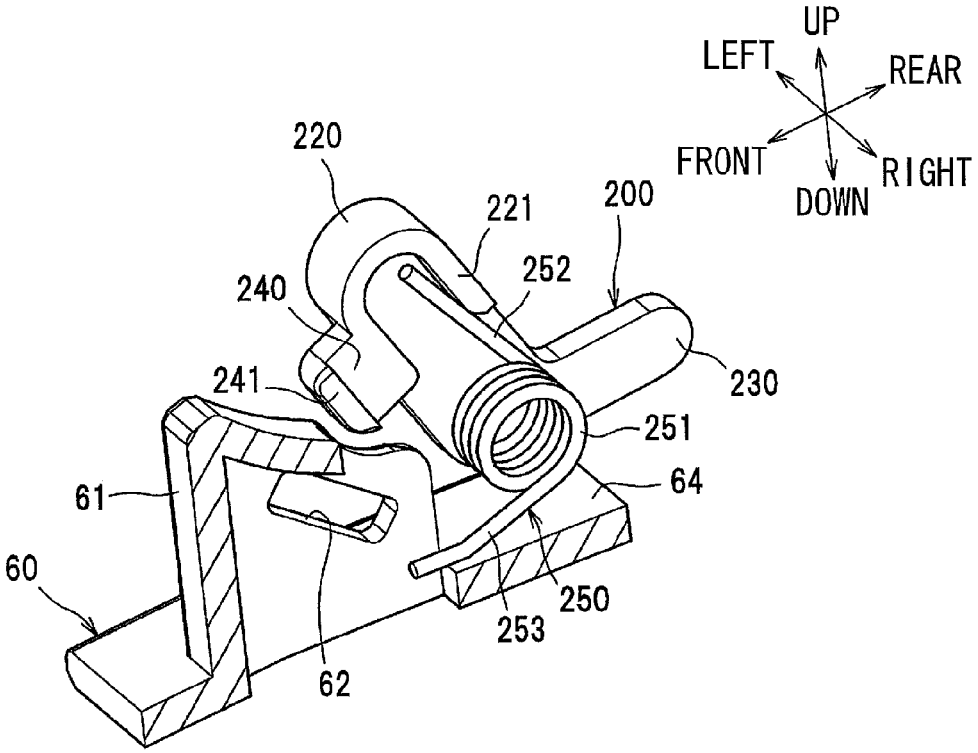
FIG. 3 is a perspective view showing a pivoting member shown in FIG. 2B from its back side.

As shown in FIG. 3, an engaging protrusion 241 is formed on the distal edge of the engaging part 240. The engaging protrusion 241 protrudes inward (rightward) toward the left side wall 61 of the drum-cartridge frame 60. An engaging hole 62 is also formed in the drum-cartridge frame 60 at a position for engaging with the engaging protrusion 241 when the first arm 220 is in the non-contact position. Hence, the engaging protrusion 241 of the pivoting member 200 and the engaging hole 62 formed in the drum-cartridge frame 60 constitute a locking mechanism for locking the pivoting member 200 in the non-contact position when the pivoting member 200 has moved from the contact position to the non-contact position.

A torsion coil spring 250 is also provided on the pivoting member 200 for urging the pivoting member 200 to pivot in the clockwise direction of FIG. 3. In other words, the torsion coil spring 250 urges the first arm 220 toward the contact position.

More specifically, the torsion coil spring 250 is configured of a coil part 251, and first and second arms 252 and 253 extending from opposing ends of the coil part 251. The coil part 251 is coaxially supported on the shaft part 210 (not shown in FIG. 3) of the pivoting member 200. The first arm 252 contacts a protrusion 221 that protrudes inward (rightward) from the inner edge (right edge) of the first arm 220. The second arm 253 contacts a rib 64 that protrudes outward (leftward) from the left side wall 61 of the drum-cartridge frame 60. The torsion coil spring 250 urges the pivoting member 200 clockwise in FIG. 3. Pivoting of the pivoting member 200 is restricted when the second arm 230 contacts the boss 63.

When the drum cartridge 6 is a new product, the pivoting member 200 having the above construction is oriented such that the first arm 220 is in the contact position.

Figure 4A:
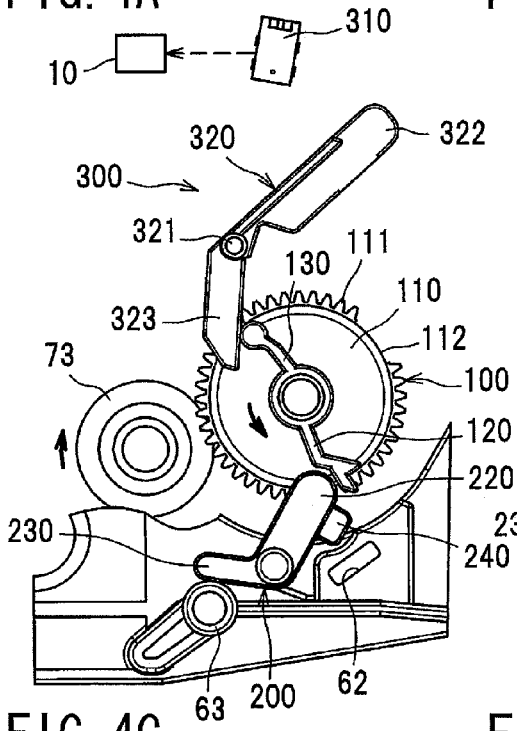
FIGS. 4A-4D illustrate the operations of the sensor gear and the pivoting member for the case in which a developer cartridge and a drum cartridge are both in a new state, and show the states of the sensor gear and the pivoting member from when the sensor gear is at a transmission position until when the sensor gear reaches the non-transmission position.

As shown in FIG. 4A, an agitator gear 73 (as an example of a second rotary body) is rotatably provided in the developer-cartridge frame 70. The agitator gear 73 is configured to rotate together with the agitator 16. The agitator gear 73 is also coupled to the input gear 71 and is configured to rotate when a drive force is inputted into the input gear 71.

The sensor gear 100 is arranged such that the peripheral surface of the body part 110 confronts the peripheral surface of the agitator gear 73. Around the peripheral surface of the body part 110, the sensor gear 100 has a toothed portion 111 (as an example of a transmission part), and a toothless portion 112 (as an example of a non-transmission part).

The toothed portion 111 includes gear teeth that can engage with the agitator gear 73. When the toothed portion 111 is positioned opposite the agitator gear 73, the drive force transmitted from the agitator gear 73 rotates the sensor gear 100. The toothless portion 112 is provided with no gear teeth. Thus, when the toothless portion 112 is positioned opposite the agitator gear 73, the drive force of the agitator gear 73 is not transmitted to the sensor gear 100. The toothless portion 112 is disposed downstream of the first detection part 120 and upstream of the second detection part 130 with respect to the rotating direction of the sensor gear 100.

Figure 4B:
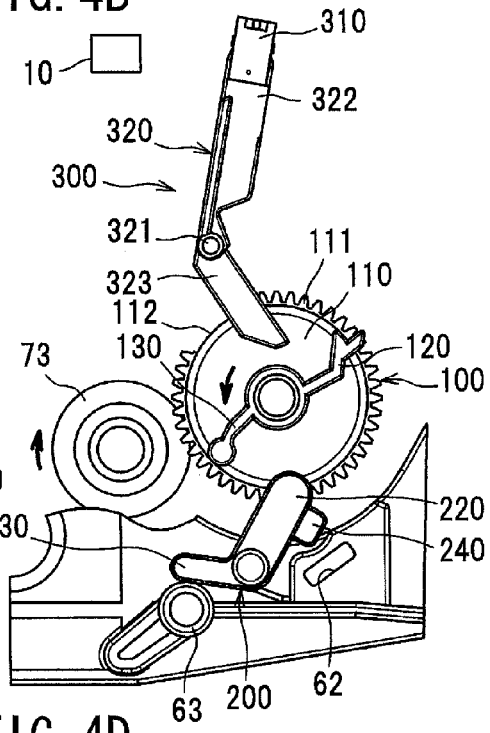
Figure 4C:
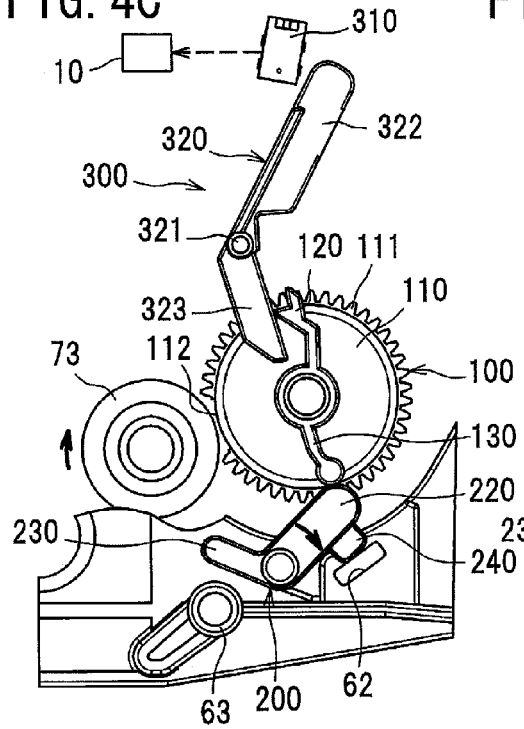
Figure 4D:
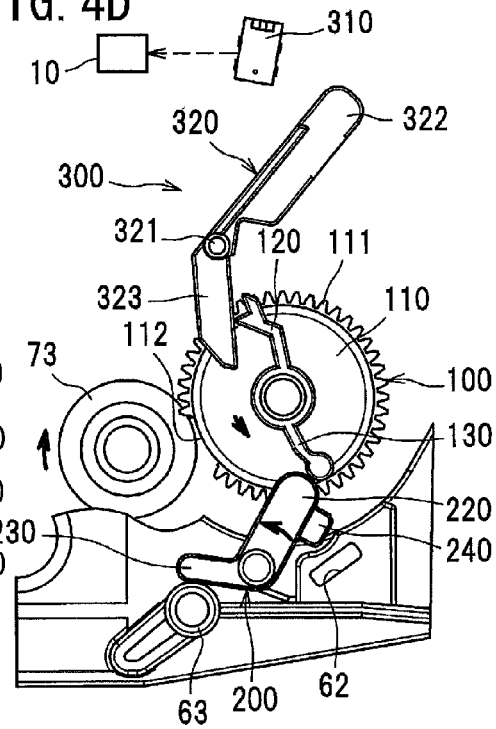

The sensor gear 100 can rotate between a transmission position (as an example of a first position) shown in FIG. 4A, for example, in which the toothed portion 111 confronts the agitator gear 73, and a non-transmission position (as an example of a second position) shown in FIG. 4C, for example, in which the toothless portion 112 opposes the agitator gear 73. The sensor gear 100 reaches the non-transmission position when the sensor gear 100 has rotated by a prescribed amount from the transmission position.

When the developer cartridge 7 is in a new state, the sensor gear 100 having the construction described above is in the transmission position. In this state, the first detection part 120 is positioned downstream in the rotating direction of the sensor gear 100 from the first arm 220 of the pivoting member 200, which is in the contact position. Further, the second detection part 130 is disposed upstream in the rotating direction from the first arm 220. By arranging the first and second detection parts 120 and 130 at positions relative to the first arm 220 in this way, it is ensured that the first detection part 120 does not contact the first arm 220 so as not to move the first arm 220 from the contact position to the non-contact position while the sensor gear 100 moves from the transmission position to the non-transmission position.

Further, the second detection part 130 is disposed in a position for contacting a contact arm 323 of the sensing mechanism 300 described later.

Structure of the Laser Printer Related to Sensing the Process Cartridge

Next, the structure of the laser printer 1 related to sensing the process cartridge 5 will be described. The laser printer 1 includes a drive mechanism (not shown) that is well known in the art. The drive mechanism can input a drive force into the input gear 71 of the process cartridge 5 while the process cartridge 5 is mounted in the main casing 2. The laser printer 1 is also provided with a sensing mechanism 300, and a control unit 10 shown in FIG. 4A.

The sensing mechanism 300 functions to detect the first and second detection parts 120 and 130. The sensing mechanism 300 is primarily configured of a photosensor 310, and a sensing arm 320.

The photosensor 310 includes a light-emitting element and a light-receiving element (not shown) that are disposed in confrontation with each other. When light transmitted from the light-emitting element to the light-receiving element is not interrupted, the photosensor 310 outputs an ON signal to the control unit 10.

The sensing arm 320 is provided with a cylindrical part 321 that is rotatably supported in the main casing 2, and a light-shielding arm 322 and a contact arm 323 that extend radially outward from the cylindrical part 321. The light-shielding arm 322 and contact arm 323 of the sensing mechanism 300 are capable of pivoting about the cylindrical part 321.

A coil spring (not shown) is mounted at a suitable position on the light-shielding arm 322 of the sensing arm 320. The coil spring constantly urges the sensing arm 320 toward a non-detection position (the orientation shown in FIG. 4B).

When the sensing arm 320 is in this non-detection position, the distal end of the light-shielding arm 322 is positioned between the light-emitting element and light-receiving element of the photosensor 310. In the same position, the distal end of the contact arm 323 is disposed in a position capable of contacting the first and second detection parts 120 and 130 protruding from the outer surface of the process cartridge 5 while the process cartridge 5 is mounted in the main casing 2. When the process cartridge 5 is mounted in the main casing 2 and the second detection part 130 contacts the distal end of the contact arm 323, the light-shielding arm 322 is pivoted clockwise in the drawings of FIGS. 4A-4D into a detection position (the orientation shown in FIG. 4A), and the distal end of the light-shielding arm 322 is retracted from a position between the light-emitting element and light-receiving element of the photosensor 310.

The control unit 10 functions to control operations of the laser printer 1. In the embodiment, the control unit 10 executes an operation for driving the developing roller 18, supply roller 19, agitator 16, and the like in a preliminary rotation (hereinafter called an "idle rotation operation") when the process cartridge 5 is mounted in the main casing 2 (for example, when a signal indicating that the front cover 2A has been closed is received from a sensor provided for detecting opening and closing of the front cover 2A). The control unit 10 determines whether the drum cartridge 6 and developer cartridge 7 are new products based on signals received from the photosensor 310 while executing the idle rotation operation. Details of the operation will be described later.

Operations for Sensing the Process Cartridge

Next, the operations of the laser printer 1 for sensing the process cartridge 5 will be described.

When the Drum Cartridge and Developer Cartridge are Both New

First the operations of the laser printer 1 will be described for the case in which the drum cartridge 6 and developer cartridge 7 are both new products. When the process cartridge 5 having both a new drum cartridge 6 and a new developer cartridge 7 is mounted in the main casing 2, the second detection part 130 of the sensor gear 100 contacts the contact arm 323 of the sensing mechanism 300, as shown in FIG. 4A. This contact moves the light-shielding arm 322 of the sensing arm 320 from the non-detection position to the detection position, causing the photosensor 310 to output a signal to the control unit 10.

When the process cartridge 5 is mounted in the main casing 2, the control unit 10 executes the idle rotation operation by controlling a drive mechanism (not shown) to input a drive force into the input gear 71 of the process cartridge 5. When the drive force is inputted into the process cartridge 5, the drive force is transmitted from the agitator gear 73 to the toothed portion 111 of the sensor gear 100, and the sensor gear 100 begins to rotate.

When the sensor gear 100 rotates from the drive force inputted from the main casing 2, the second detection part 130 is displaced counterclockwise in the drawings and separates from the contact arm 323, as shown in FIG. 4B. With the second detection part 130 no longer contacting the contact arm 323, the light-shielding arm 322 of the sensing arm 320 shifts back to the non-detection position, halting output of the signal from the photosensor 310 to the control unit 10.

As the sensor gear 100 continues to rotate, the toothless portion 112 of the sensor gear 100 becomes positioned opposite the agitator gear 73, as illustrated in FIG. 4C. When the sensor gear 100 is switched from the transmission position to the non-transmission position in this way, rotation of the sensor gear 100 comes to a halt. At this time, the first detection part 120 contacts the contact arm 323 of the sensing mechanism 300, causing the light-shielding arm 322 to pivot into the detection position. As a result, the photosensor 310 again outputs a signal to the control unit 10.

At the same time, the second detection part 130 contacts the first arm 220 of the pivoting member 200 from the side upstream in the rotating direction of the sensor gear 100. This contact pivots the pivoting member 200, moving the first arm 220 from the contact position to the non-contact position. In this way, the sensor gear 100 can rotate smoothly without the second detection part 130 getting caught up on the first arm 220.

When the first arm 220 is pushed by the second detection part 130, the engaging protrusion 241 on the engaging part 240 approaches but stops just short of the engaging hole 62 and, hence, does not engage with the engaging hole 62. Accordingly, the urging force of the torsion coil spring 250 returns the first arm 220 to the contact position shown in FIG. 4D. When returning to the contact position, the first arm 220 pushes the second detection part 130 in the rotating direction of the sensor gear 100, whereby the sensor gear 100 rotates just enough to again position the toothed portion 111 opposite the agitator gear 73. In other words, when urged back to the contact position, the first arm 220 pushes the second detection part 130 of the sensor gear 100, which is in the non-transmission position, rotating the sensor gear 100 to the transmission position.

Figure 5A:
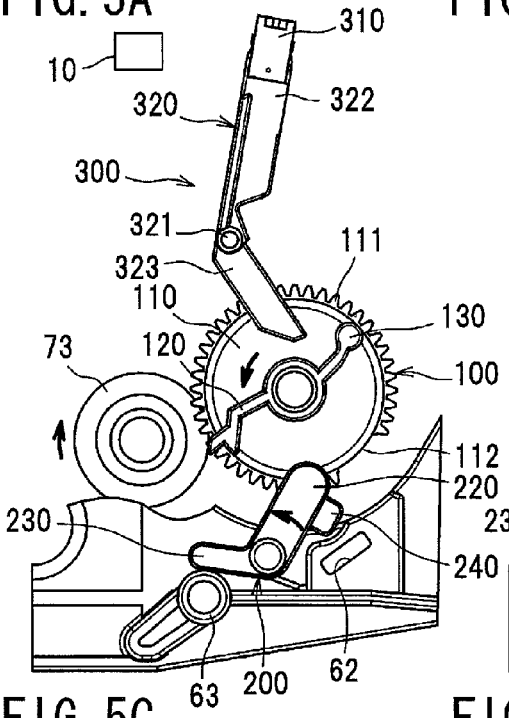
FIGS. 5A-5D illustrate the operations of the sensor gear and the pivoting member for the case in which the developer cartridge and the drum cartridge are both in a new state, and show the states of the sensor gear and the pivoting member after the sensor gear and the pivoting member are at the state of FIG. 4D until when the sensor gear comes to a halt.

When the sensor gear 100 once again begins to rotate, the first detection part 120 is displaced counterclockwise in the drawing and separates from the contact arm 323, as illustrated in FIG. 5A. As a result, the light-shielding arm 322 of the sensing arm 320 moves into the non-detection position, halting output of the signal from the photosensor 310 to the control unit 10.

Figure 5B:
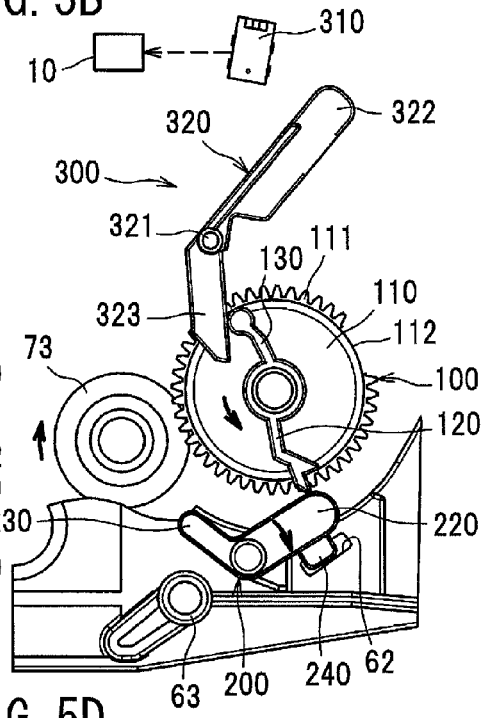

As the sensor gear 100 continues to rotate, the second detection part 130 contacts the contact arm 323, moving the light-shielding arm 322 into the detection position, as shown in FIG. 5B. As a result, the photosensor 310 outputs a signal to the control unit 10.

At this time, the first detection part 120 contacts the first arm 220. Pressure from the first detection part 120 moves the first arm 220 toward the non-contact position. Because the distal end of the first detection part 120 is further separated from the center of the sensor gear 100 than the distal end of the second detection part 130 in the embodiment, the first arm 220 pivots farther when pressed by the first detection part 120 than when pressed by the second detection part 130 and moves all the way into the non-contact position. Consequently, the engaging protrusion 241 provided on the engaging part 240 of the pivoting member 200 becomes engaged in the engaging hole 62 formed in the drum-cartridge frame 60, locking the first arm 220 in the non-contact position. Hence, after the first arm 220 has rotated the sensor gear 100 from the non-transmission position to the transmission position, the first arm 220 moves into the non-contact position in association with the rotation of the sensor gear 100 before the sensor gear 100 rotates back to the non-transmission position.

As described above, the first arm 220 becomes locked in the non-contact position when moved therein, and is prevented from returning inadvertently to the contact position.

Figure 5C:
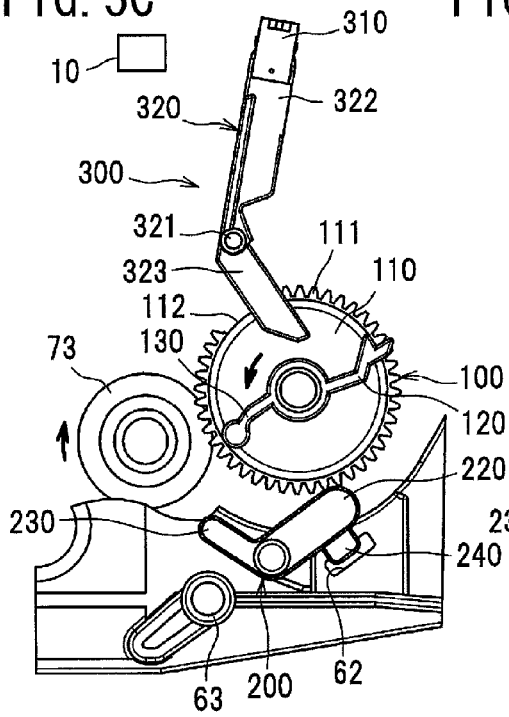

As the sensor gear 100 continues to rotate, the second detection part 130 is displaced counterclockwise in the drawings so as to separate from the contact arm 323, as illustrated in FIG. 5C. As a result, the light-shielding arm 322 moves to the non-detection position, halting signal output from the photosensor 310 to the control unit 10.

Figure 5D:
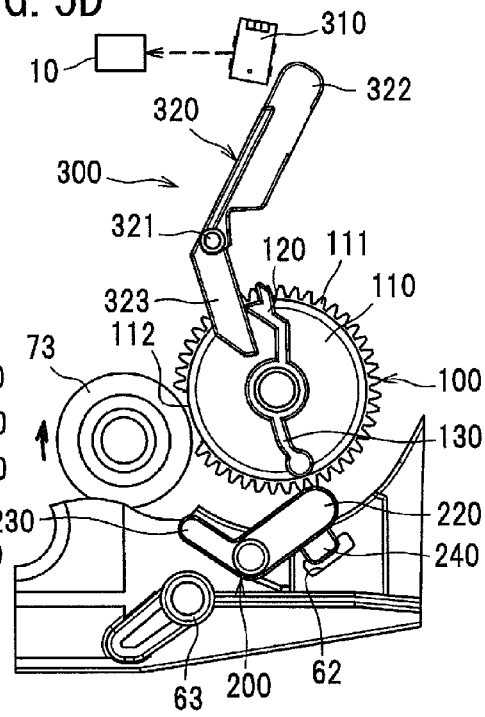

As shown in FIG. 5D, the sensor gear 100 comes to a halt after switching from the transmission position to the non-transmission position. At this time, the first detection part 120 is in contact with the contact arm 323 and has moved the light-shielding arm 322 to the detection position, whereby the photosensor 310 again outputs a signal to the control unit 10.

Figure 6:
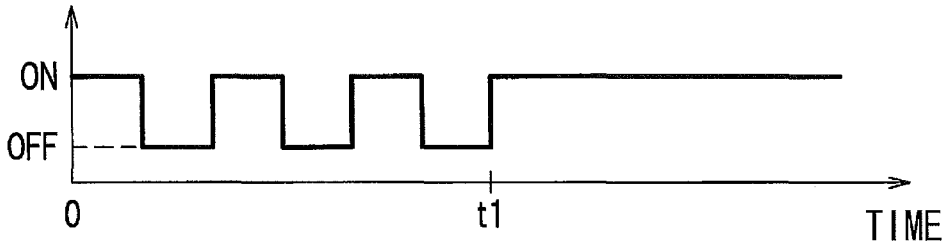
FIG. 6 shows a signal outputted from a photosensor to a control unit for the case in which the developer cartridge and the drum cartridge are both in a new state.

As described above, when the drum cartridge 6 and developer cartridge 7 are in a new state, signal output from the photosensor 310 is halted (turned to its OFF state) three times from the start of the idle rotation operation (time zero) to a predetermined time t1 (the time required for the sensor gear 100 to complete about two rotations), as illustrated in FIG. 6. Based on these signals, the control unit 10 determines that both the drum cartridge 6 and developer cartridge 7 are new.

When the Drum Cartridge is New and the Developer Cartridge is Used

Figure 7A:
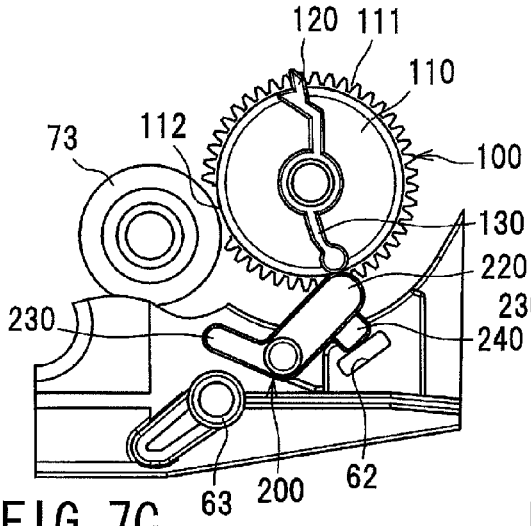
FIGS. 7A-7D illustrate the operations of the sensor gear and the pivoting member for the case in which a developer cartridge is in a used state and a drum cartridge is in a new state, and show the states of the sensor gear and the pivoting member until when contact between a first detection part and a contact arm is released.

Next, the operations performed on the laser printer 1 when a process cartridge 5 whose drum cartridge 6 is in a new state and whose developer cartridge 7 is in a used state is mounted in the main casing 2. Because the developer cartridge 7 is in a used state, the sensing operation described above has already been performed for the developer cartridge 7 and, hence, the sensor gear 100 is disposed in the non-transmission position, as shown in FIG. 7A. At this time, the first detection part 120 is positioned to be able to contact the contact arm 323 of the sensing mechanism 300, and the second detection part 130 is positioned to be able to contact the first arm 220 of the pivoting member 200, which is in the contact position.

Figure 7B:
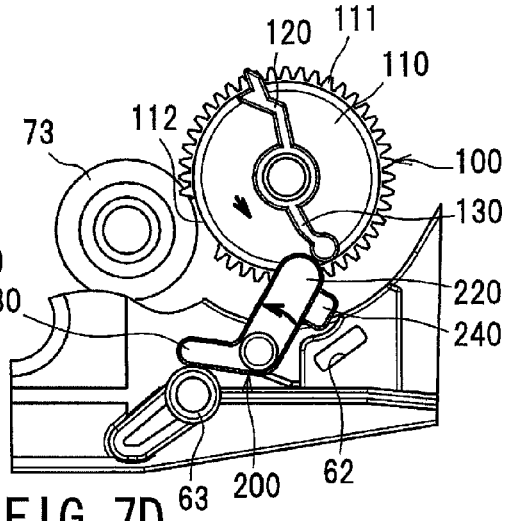

When this developer cartridge 7 is mounted in a new drum cartridge 6, the second detection part 130 contacts the first arm 220, pivoting the first arm 220 from its contact position in a direction toward the non-contact position. However, the urging force of the torsion coil spring 250 returns the first arm 220 to its contact position, as shown in FIG. 7B. At this time, the first arm 220 pushes the second detection part 130 in the rotating direction of the sensor gear 100, causing the sensor gear 100 to rotate just enough that the toothed portion 111 becomes positioned opposite the agitator gear 73.

Figure 7C:
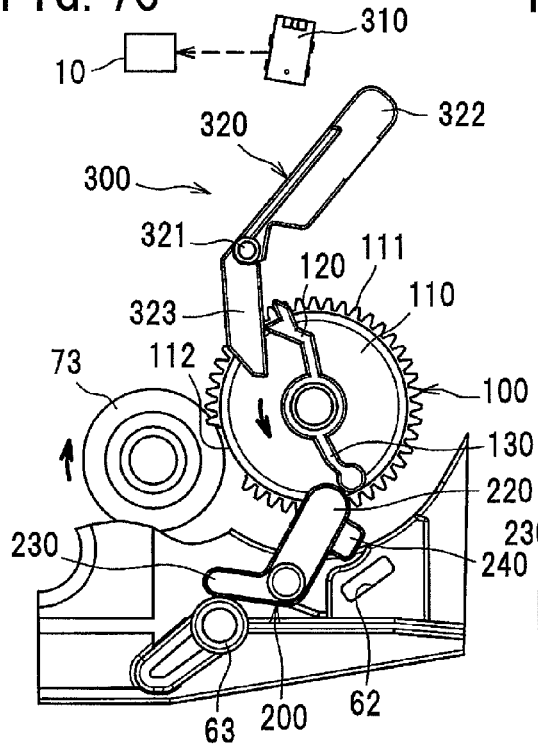

When the process cartridge 5 is subsequently mounted in the main casing 2, the first detection part 120 contacts the contact arm 323, moving the light-shielding arm 322 into the detection position, as illustrated in FIG. 7C. Consequently, the photosensor 310 outputs a signal to the control unit 10.

Figure 7D:
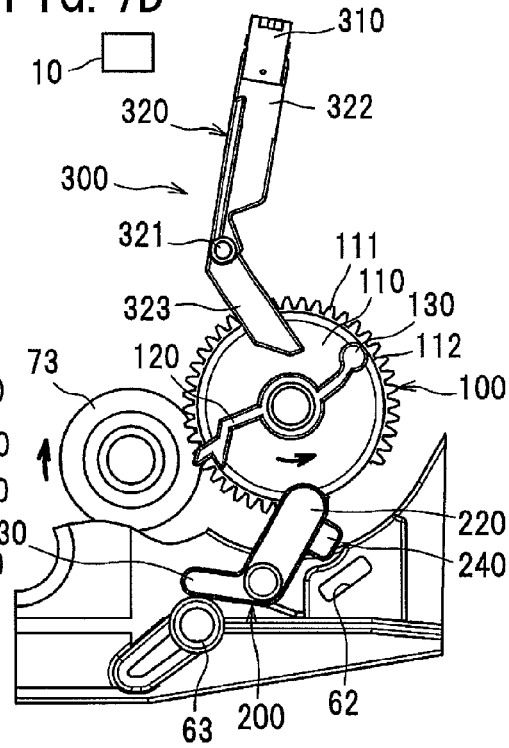

When the agitator gear 73 begins to rotate at the beginning of the idle rotation operation, the sensor gear 100 also begins to rotate. When the sensor gear 100 rotates, the first detection part 120 is displaced counterclockwise in the drawing until the first detection part 120 separates from the contact arm 323, as shown in FIG. 7D. Once contact is removed between the first detection part 120 and the contact arm 323, the light-shielding arm 322 moves back to the non-detection position, halting the output of a signal from the photosensor 310 to the control unit 10.

Figure 8A:
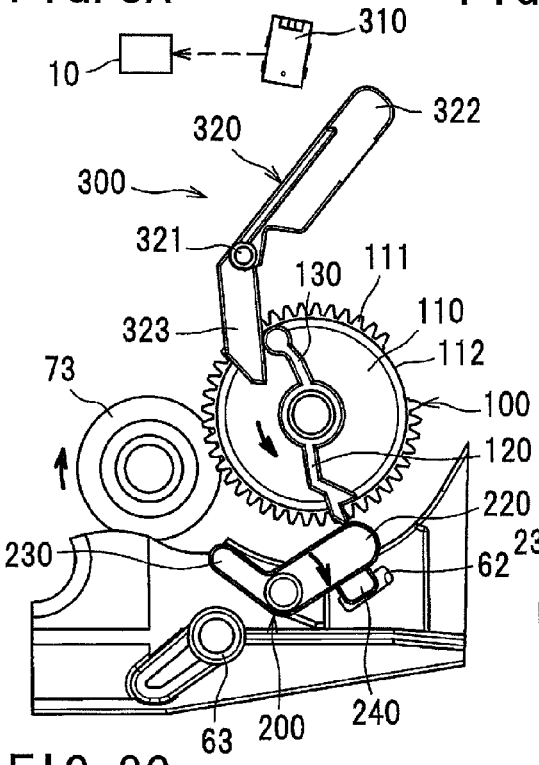
FIGS. 8A-8C illustrate the operations of the sensor gear and the pivoting member for the case in which the developer cartridge is in a used state and the drum cartridge is in a new state, and show the states of the sensor gear and the pivoting member after the sensor gear and the pivoting member are at the state of FIG. 7D until when the sensor gear comes to a halt.

As the sensor gear 100 continues to rotate, the second detection part 130 contacts the contact arm 323, moving the light-shielding arm 322 into the detection position, as shown in FIG. 8A. As a result, the photosensor 310 outputs a signal to the control unit 10.

At the same time, the first detection part 120 contacts the first arm 220 of the pivoting member 200. Pressure from the first detection part 120 moves the first arm 220 toward the non-contact position. The engaging protrusion 241 becomes engaged in the engaging hole 62, locking the first arm 220 in the non-contact position.

Figure 8B:
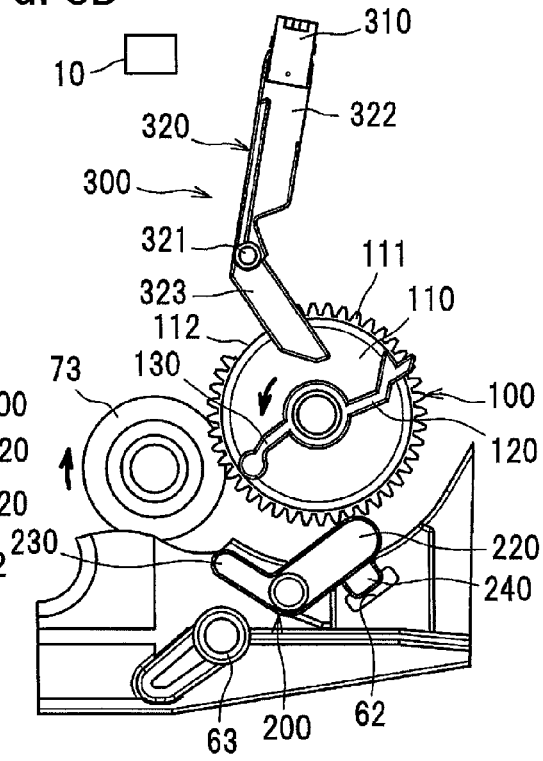

As the sensor gear 100 continues to rotate, the second detection part 130 is displaced counterclockwise in the drawings and separates from the contact arm 323, as shown in FIG. 8B. When the second detection part 130 no longer contacts the contact arm 323, the light-shielding arm 322 moves back to the non-detection position, halting output of the signal from the photosensor 310 to the control unit 10.

Figure 8C:
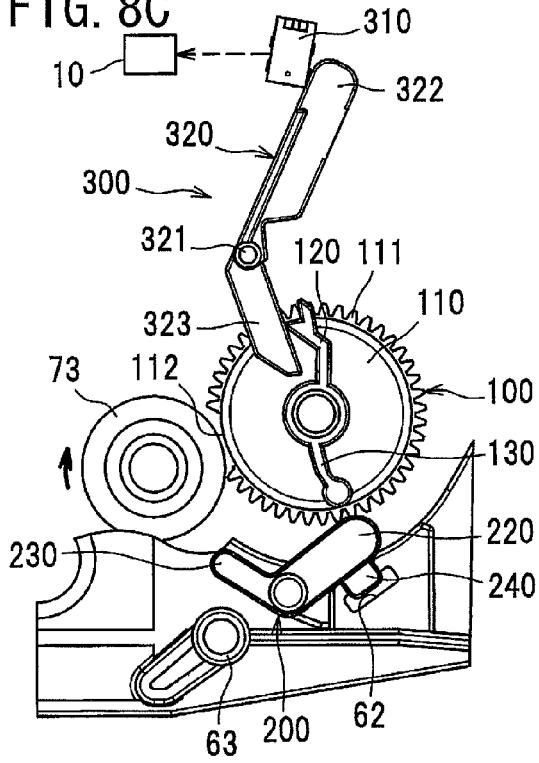

The sensor gear 100 comes to a halt after switching from the transmission position to the non-transmission position, as shown in FIG. 8C. At this time, the first detection part 120 is in contact with the contact arm 323, maintaining the light-shielding arm 322 in the detection position so that the photosensor 310 continues to output a signal to the control unit 10.

Figure 9:
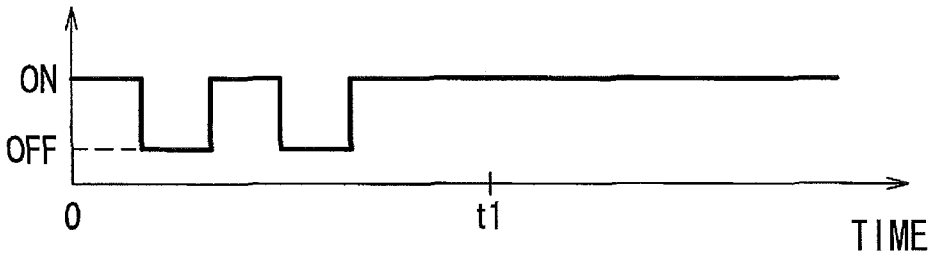
FIG. 9 shows a signal outputted from the photosensor to the control unit for the case in which the developer cartridge is in a used state and the drum cartridge is in a new state.

When the drum cartridge 6 is in a new state and the developer cartridge 7 in a used state as described above, the signal outputted from the photosensor 310 is halted (switched to the OFF state) twice within the predetermined time t1 after the start of the idle rotation operation, as illustrated in FIG. 9. Based on this signal, the control unit 10 can therefore determine that the drum cartridge 6 is in a new state and the developer cartridge 7 is in a used state.

When the Drum Cartridge is Used and the Developer Cartridge is New

Figure 10A:
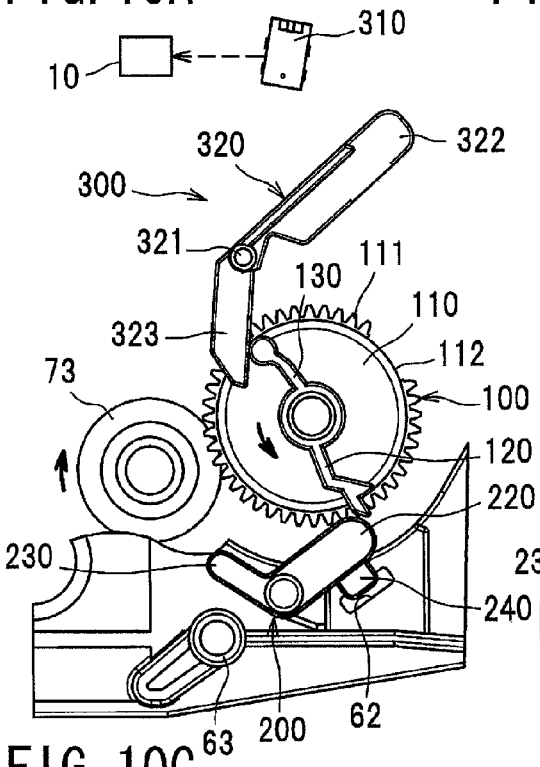
FIGS. 10A-10C illustrate the operations of the sensor gear and the pivoting member for the case in which the developer cartridge is in a new state and the drum cartridge is in a used state.

Next, the operations performed by the laser printer 1 will be described for the case in which the drum cartridge 6 is in a used state and the developer cartridge 7 is in a new state. When the drum cartridge 6 is in a used state, the first arm 220 of the pivoting member 200 is in the non-contact position, as illustrated in FIG. 10A.

When the process cartridge 5 is mounted in the main casing 2, the second detection part 130 contacts the contact arm 323, moving the light-shielding arm 322 into the detection position. As a result, the photosensor 310 outputs a signal to the control unit 10.

Figure 10B:
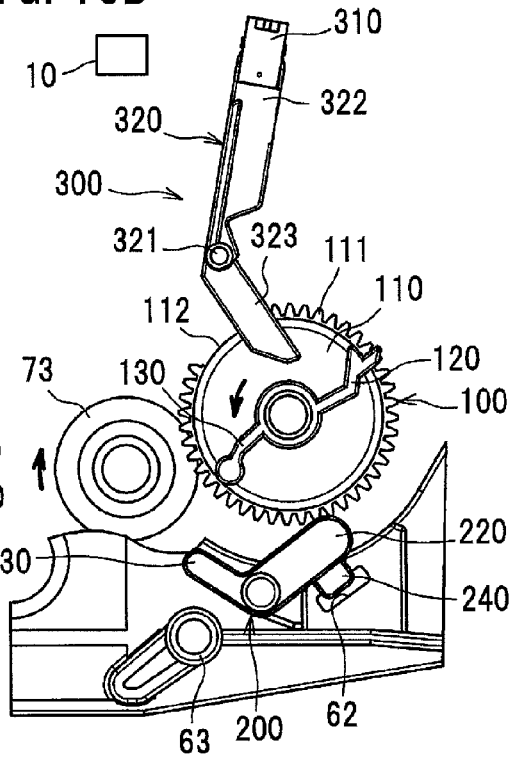

When the sensor gear 100 begins rotating at the beginning of the idle rotation operation, the second detection part 130 is displaced counterclockwise in the drawing and separates from the contact arm 323, as illustrated in FIG. 10B. Consequently, the light-shielding arm 322 moves back to the non-detection position, halting output of the signal from the photosensor 310 to the control unit 10.

Figure 10C:
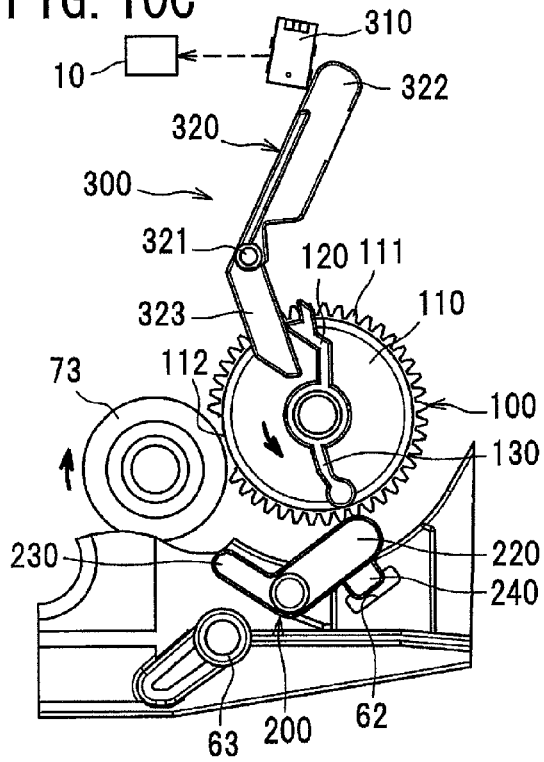

The sensor gear 100 comes to a halt after switching from the transmission position to the non-transmission position, as shown in FIG. 10C. At this time, the first detection part 120 is in contact with the contact arm 323, maintaining the light-shielding arm 322 in the detection position. Accordingly, the photosensor 310 outputs a signal to the control unit 10.

Figure 11:
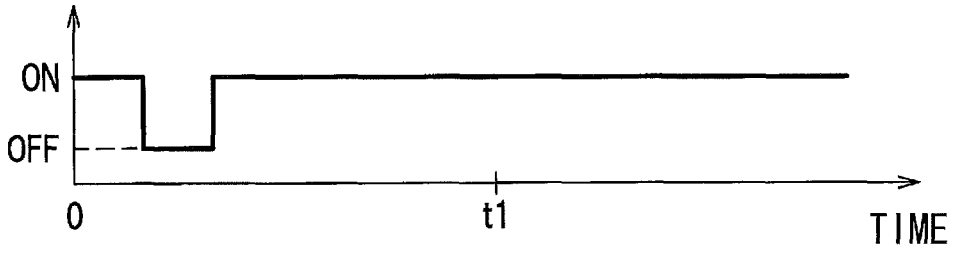
FIG. 11 shows a signal outputted from the photosensor to the control unit for the case in which the developer cartridge is in a new state and the drum cartridge is in a used state.

Thus, when the drum cartridge 6 is in a used state and the developer cartridge 7 in a new state as described above, the signal outputted from the photosensor 310 is halted (switched to an OFF state) only once within the predetermined time t1 after the start of the idle rotation operation, as illustrated in FIG. 11. Therefore, the control unit 10 can determine that the drum cartridge 6 is used and the developer cartridge 7 is new based on this signal.

When the Drum Cartridge and Developer Cartridge are Both Used

Figure 12A:
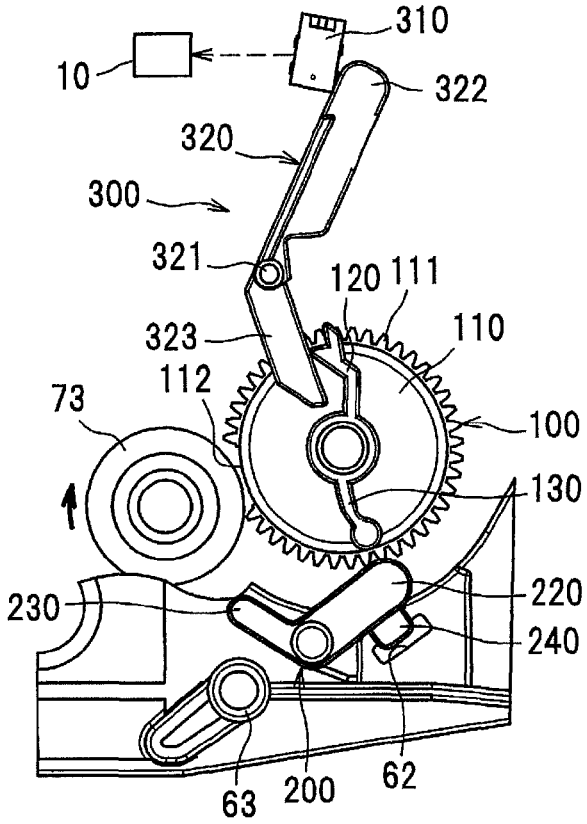
FIG. 12A illustrates the operations of the sensor gear and the pivoting member for the case in which the developer cartridge and the drum cartridge are both in a used state.

Next, the operations performed by the laser printer 1 for the case in which both the drum cartridge 6 and developer cartridge 7 are in a used state. When the process cartridge 5 is mounted in the main casing 2, the first detection part 120 contacts the contact arm 323, moving the light-shielding arm 322 into the detection position, as illustrated in FIG. 12A. Consequently, the photosensor 310 outputs a signal to the control unit 10.

Figure 12B:
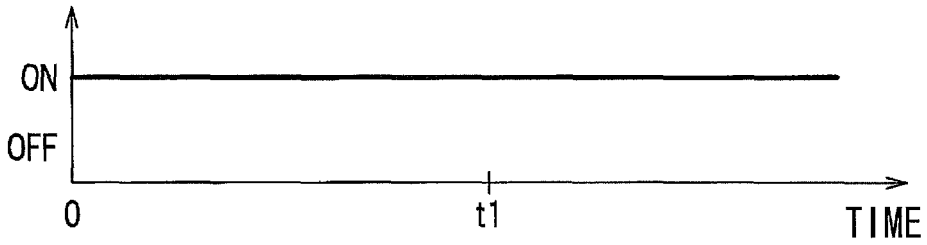
FIG. 12B shows a signal outputted from the photosensor to the control unit for the case in which the developer cartridge and the drum cartridge are both in a used state.

Because the sensor gear 100 is in the non-transmission position and the first arm 220 is in the non-contact position, the sensor gear 100 does not rotate even from the beginning of the idle rotation operation. Thus, when both the drum cartridge 6 and developer cartridge 7 are in a used state as described above, the signal is continuously outputted (remains in an ON state) from the photosensor 310 during the predetermined time t1 after the start of the idle rotation operation, as illustrated in FIG. 12B. Therefore, the control unit 10 can determine that both the drum cartridge 6 and developer cartridge 7 are used based on this signal.

The following effects can be obtained from the process cartridge 5 according to the first embodiment described above. Because the laser printer 1 can detect whether the drum cartridge 6 is in a new state using the same mechanism for detecting whether the developer cartridge 7 is in a new state (i.e., the sensor gear 100 and sensing mechanism 300), there is no need to provide separate detect means for each of the drum cartridge 6 and developer cartridge 7. Accordingly, this arrangement reduces the number of required parts.

Hence, when the sensor gear 100 rotates while the first arm 220 of the pivoting member 200 is in the contact position, the first detection part 120 provided on the sensor gear 100 is configured to move the first arm 220 of the pivoting member 200 to the non-contact position. Accordingly, this method simplifies the structure for associating movement of the first arm 220 from the contact position to the non-contact position with rotation of the sensor gear 100.

Further, the first detection part 120 of the sensor gear 100 that is detected by the sensing mechanism 300 also contacts the first arm 220 and is capable of moving the first arm 220 from the contact position to the non-contact position. Thus, this arrangement provides a simpler construction than when a member other than the first detection part 120 is provided for moving the first arm 220.

Further, when returning to its contact position, the first arm 220 is configured to rotate the sensor gear 100 from the non-transmission position to the transmission position by contacting the second detection part 130, which is also a member detected by the sensing mechanism 300. This achieves a simpler construction than when a separate member from the second detection part 130 is provided for the first arm 220 to push.

The first arm 220 is configured to move from the contact position and then move back to the contact position when the second detection part 130 contacts the first arm 220 from an upstream side of the first arm 220 in the rotating direction while the sensor gear 100 rotates from the transmission position to the non-transmission position. This configuration ensures that the second detection part 130 does not move the first arm 220 to the non-contact position before the first detection part 120 contacts the first arm 220. So, detection error can be restrained.

The first arm 220 is urged toward the contact position. This arrangement ensures that the first arm 220 returns to the contact position.

The first detection part 120 extends further outward in a radial direction of the sensor gear 100 than the second detection part 130. This arrangement ensures that the first detection part 120 moves the first arm 220 to the non-contact position when contacting the first arm 220.

Figure 13:
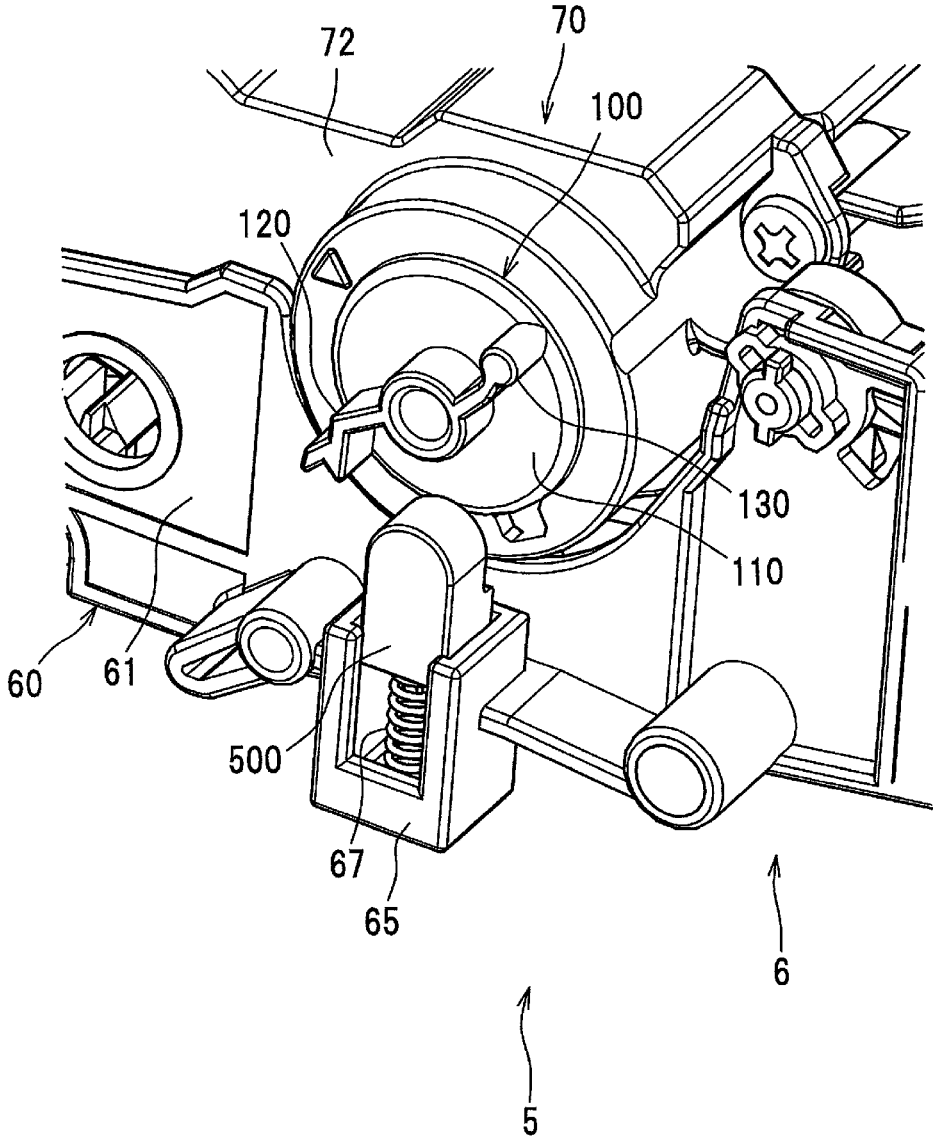
FIG. 13 illustrates an elevating member according to a modification of the first embodiment.

In the first embodiment described above, the first arm 220 of the pivoting member 200 serving as an example of a moving member is pivotably provided relative to the drum-cartridge frame 60, but the present invention is not limited to this configuration. FIG. 13 shows an elevating member 500 as another example of the moving member. The elevating member 500 can move linearly relative to the drum-cartridge frame 60.

More specifically, the elevating member 500 is provided in an elevating-member accommodating unit 65 formed on the drum-cartridge frame 60 and is capable of moving vertically therein. Through this vertical movement in the elevating-member accommodating unit 65, the elevating member 500 can move between a contact position and a non-contact position. In the contact position, the top of the elevating member 500 is positioned in the paths of the first and second detection parts 120 and 130. In the non-contact position, the elevating member 500 is lower than in the contact position and outside the paths of the first and second detection parts 120 and 130.

A compression spring 67 is also provided in the elevating-member accommodating unit 65 for urging the elevating member 500 from the non-contact position toward the contact position. A stopper (not shown) is provided for locking the elevating member 500 in the non-contact position.

The process cartridge 5 having this construction can obtain the same effects described for the process cartridge 5 of the first embodiment.

Second Embodiment

Next, a second embodiment of the present invention will be described while referring to the accompanying drawings. In the second embodiment, the structure for sensing the new state of the developer cartridge 7 is also used to detect whether the discharge wire 12A has been cleaned. In the second embodiment, like parts and components to those in the first embodiment are designated with the same reference numerals to avoid duplicating description.

Structure of the Process Cartridge

Figure 14:
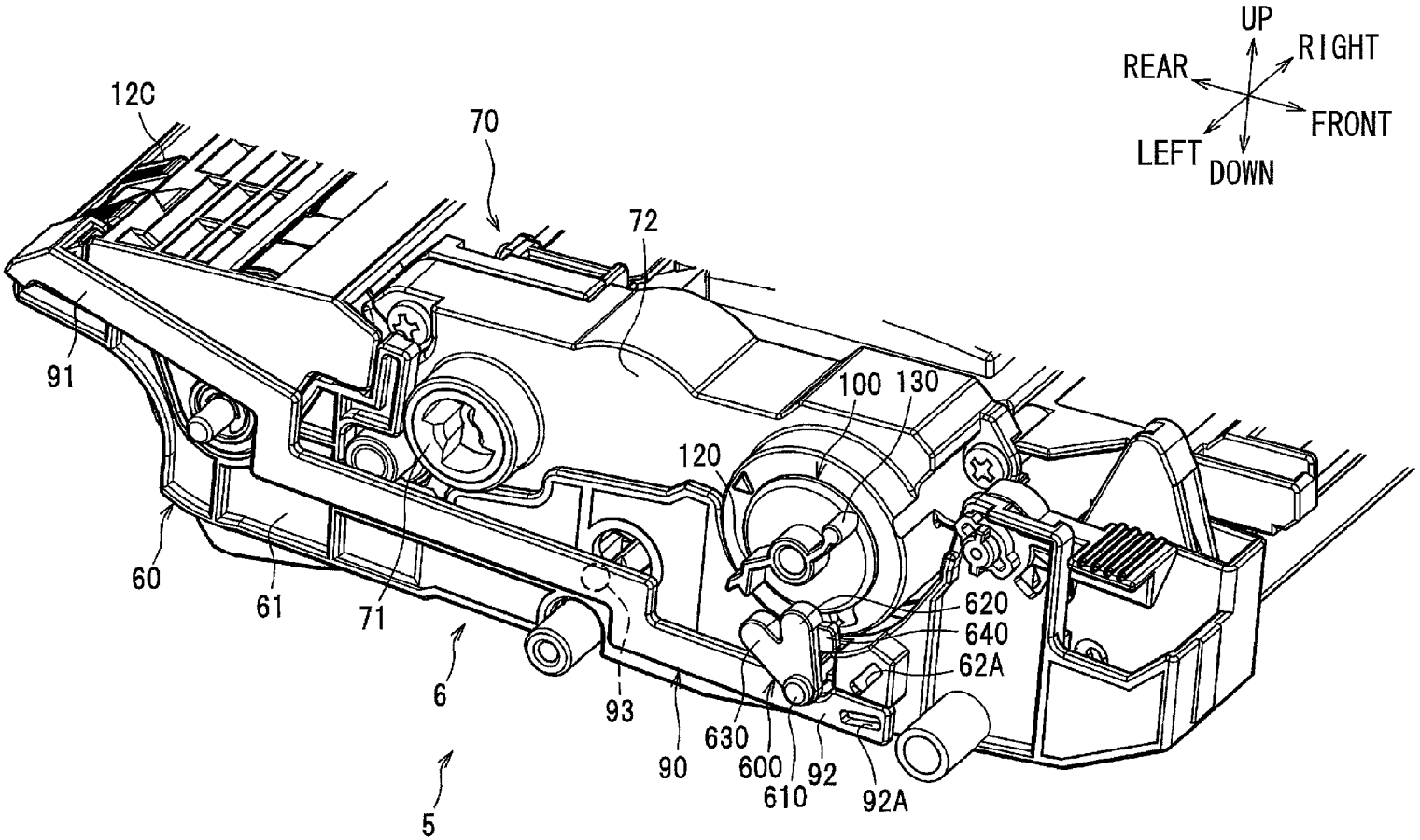
FIG. 14 is a perspective view showing a left side surface of a process cartridge according to a second embodiment.

As shown in FIG. 14, the drum cartridge 6 is provided with a wire cleaner 12C used to clean the discharge wire 12A of the charger 12, and a moving member 600 and a linking member 90 provided on the left side wall 61. The wire cleaner 12C is provided on the rear edge of the drum-cartridge frame 60 and is capable of sliding in the left-right direction relative to the drum-cartridge frame 60. The wire cleaner 12C is configured to clean the discharge wire 12A (see FIG. 1) when reciprocated in the left-right direction.

The moving member 600 is configured of a shaft part 610 pivotably supported in the drum-cartridge frame 60, and a first arm 620 (as an example of a first moving member) and a second arm 630 (as an example of a second moving member) that both extend radially outward from the shaft part 610 in a general V-shape. The second arm 630 is disposed on the rear side of the first arm 620 and is capable of moving (pivoting) together with the first arm 620.

By pivoting the moving member 600 relative to the drum-cartridge frame 60, the first and second arms 620 and 630 can be moved between their respective contact positions and non-contact positions. The first and second arms 620 and 630 can reach their non-contact positions after having pivoted clockwise in FIG. 14 from their contact positions. In the contact position, the distal end of the corresponding first and second arms 620 and 630 is disposed in the paths of the first and second detection parts 120 and 130 provided on the sensor gear 100. In the non-contact position, an entire part of the corresponding first and second arms 620 and 630 is outside the paths of the first and second detection parts 120 and 130.

More specifically, when the first arm 620 is in its contact position, the second arm 630 is disposed upstream of the first arm 620 in the direction for pivoting from the contact position to the non-contact position. When the first arm 620 is in its non-contact position, the second arm 630 is disposed in its contact position.

Hence, by pivoting, the moving member 600 can move among a first orientation in which the first arm 620 is in its contact position, a second orientation in which the first arm 620 is in its non-contact position and the second arm 630 is in its contact position, and a third orientation in which both the first and second arms 620 and 630 are in their non-contact positions. The moving member 600 is in the first orientation when the drum cartridge 6 is in a new state.

In the moving member 600 having the above configuration, a torsion coil spring (not shown) or the like is provided for urging the moving member 600 toward the first orientation.

The moving member 600 is also provided with an engaging part 640. The engaging part 640 protrudes from the first arm 620 downstream in the direction that the first arm 620 moves from the contact position to the non-contact position. An engaging protrusion (not shown) is formed on the surface of the engaging part 640 facing the left side wall 61 of the drum-cartridge frame 60.

A first engaging hole 62A is formed in the drum-cartridge frame 60 at a position forward of the shaft part 610. The engaging protrusion formed on the engaging part 640 is capable of engaging in the first engaging hole 62A.

The linking member 90 is a plate-shaped member that is elongated in the front-rear direction. The linking member 90 is provided along the left side wall 61 of the drum-cartridge frame 60.

More specifically, a rear end 91 of the linking member 90 is disposed on the left side of the wire cleaner 12C, and a front end 92 is disposed beneath the first engaging hole 62A. A second engaging hole 92A is formed in the front end 92 of the linking member 90. The engaging protrusion formed on the engaging part 640 is also capable of engaging with the second engaging hole 92A.

A pivoting support part 93 is provided at approximately the front-rear center portion of the linking member 90, for example. The pivoting support part 93 is engaged with the drum-cartridge frame 60. With this configuration, the linking member 90 can pivot about the pivoting support part 93 such that the rear end 91 and front end 92 move in the left-right direction. For example, when the wire cleaner 12C presses the rear end 91 in a direction away from the left side wall 61 of the drum-cartridge frame 60, the linking member 90 can pivot about the pivoting support part 93 such that the front end 92 moves closer to the left side wall 61.

Operations for Sensing the Process Cartridge

Next, the operations of the laser printer 1 for sensing the process cartridge 5 having the above construction will be described.

When the Drum Cartridge and Developer Cartridge are Both New

Figure 15A:
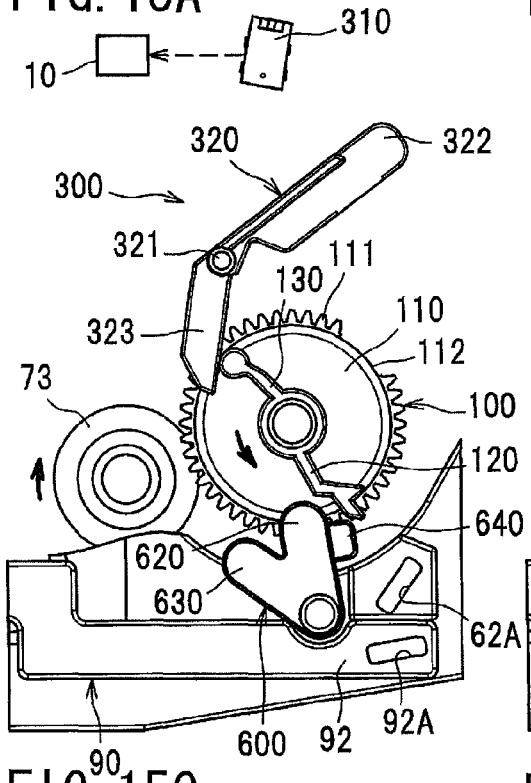
FIGS. 15A-15D illustrate the operations of a sensor gear and a moving member for the case in which a developer cartridge and a drum cartridge are both in a new state, and show the states of the sensor gear and the moving member until when a first arm moves to a non-contact position.

First, the operations of the laser printer 1 will be described for the case in which the drum cartridge 6 and developer cartridge 7 are both new products. When the process cartridge 5 having both a new drum cartridge 6 and a new developer cartridge 7 is mounted in the main casing 2, the second detection part 130 of the sensor gear 100 contacts the contact arm 323 of the sensing mechanism 300, as shown in FIG. 15A. This contact moves the light-shielding arm 322 of the sensing arm 320 to the detection position, causing the photosensor 310 to output a signal to the control unit 10.

Figure 15B:
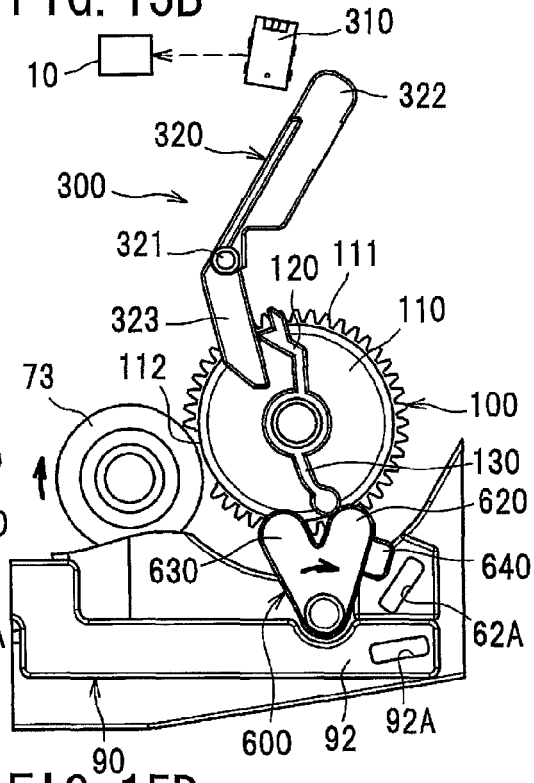

While rotating at the beginning of the idle rotation operation, the sensor gear 100 switches from the transmission position to the non-transmission position shown in FIG. 15B. At this time, the rotation of the sensor gear 100 comes to a halt with the second detection part 130 contacting the first arm 620 of the moving member 600 from the upstream side in the rotating direction of the sensor gear 100. This contact pivots the moving member 600 so that the first arm 620 moves from its contact position to its non-contact position.

Figure 15C:
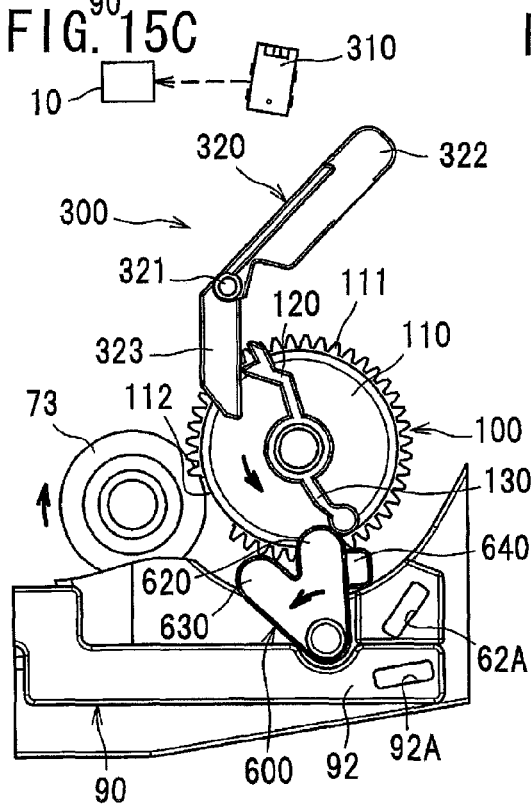

After the first arm 620 is pushed in a direction toward the non-contact position by the second detection part 130, the urging force of the torsion coil spring pivots the moving member 600 in a direction to return the first arm 620 to its contact position, as illustrated in FIG. 15C. When being returned to its contact position, the first arm 620 pushes the second detection part 130 in the rotating direction of the sensor gear 100, whereby the sensor gear 100 rotates just enough to again position the toothed portion 111 opposite the agitator gear 73.

Figure 15D:
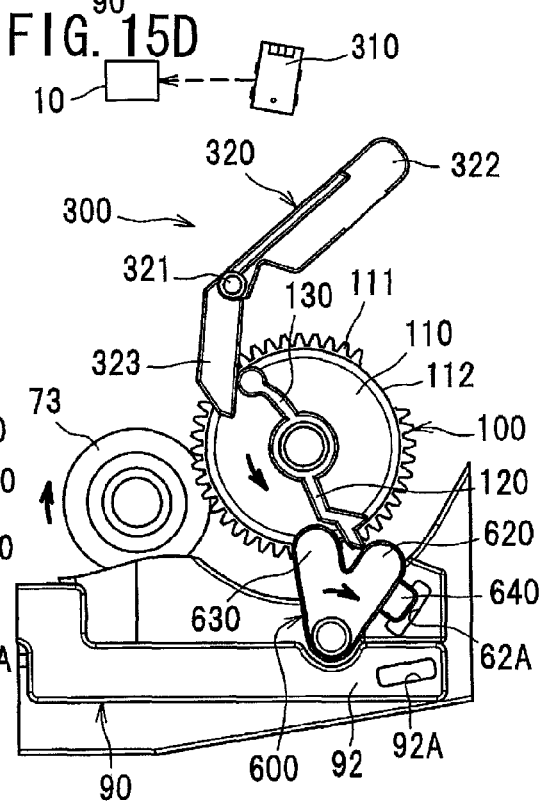

When the sensor gear 100 once again begins to rotate, the first detection part 120 contacts the first arm 620 and the pressure from the first detection part 120 moves the first arm 620 toward the non-contact position, as illustrated in FIG. 15D. Hence, the moving member 600 is displaced from its first orientation to its second orientation. At this time, the engaging protrusion provided on the engaging part 640 of the moving member 600 becomes engaged in the first engaging hole 62A formed in the drum-cartridge frame 60, locking the moving member 600 in the second orientation. In this orientation, the second arm 630 is now in the contact position.

Figure 16A:
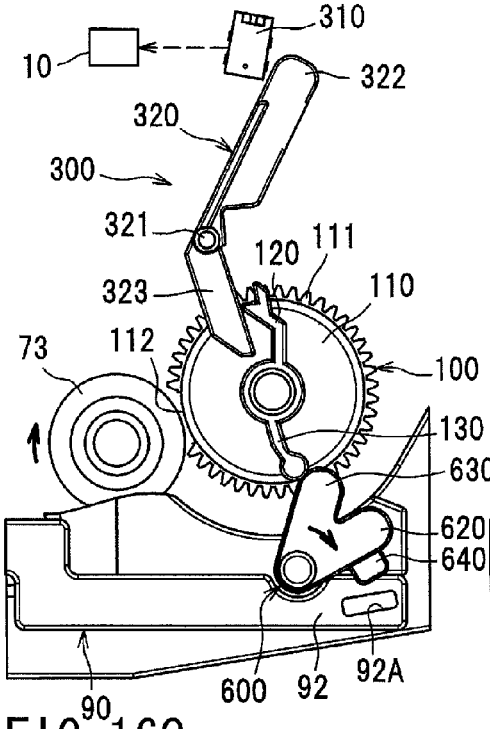
FIGS. 16A-16D illustrate the operations of the sensor gear and the moving member for the case in which the developer cartridge and the drum cartridge are both in a new state, and show the states of the sensor gear and the moving member after the sensor gear and the moving member are at the state of FIG. 15D until when the sensor gear comes to a halt.

The sensor gear 100 continues to rotate, switching from the transmission position to the non-transmission position shown in FIG. 16A. At this time, the sensor gear 100 comes to a halt with the second detection part 130 contacting the second arm 630 of the moving member 600 from the upstream side in the rotating direction of the sensor gear 100. This contact pivots the moving member 600 so that the second arm 630 moves from its contact position toward its non-contact position.

Figure 16B:
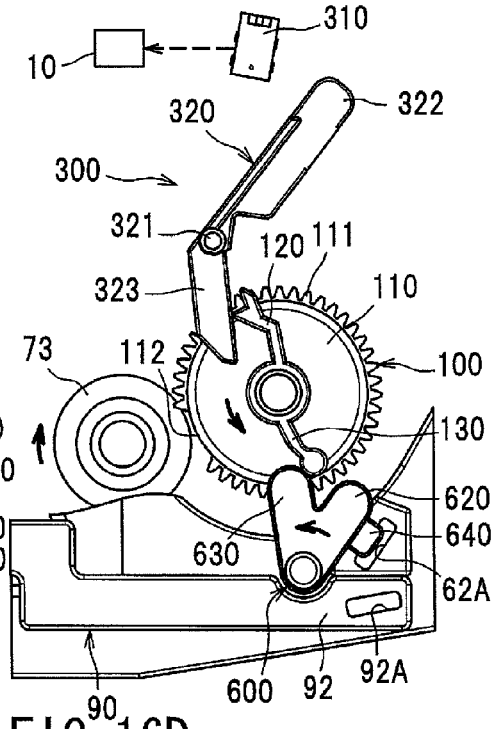

After the second detection part 130 pushes the second arm 630 toward its non-contact position, the urging force of the torsion coil spring causes the second arm 630 to return to the contact position, as shown in FIG. 16B. When returning to its contact position, the second arm 630 pushes the second detection part 130 in the rotating direction of the sensor gear 100, whereby the sensor gear 100 rotates just enough to move the toothed portion 111 again opposite the agitator gear 73.

Figure 16C:
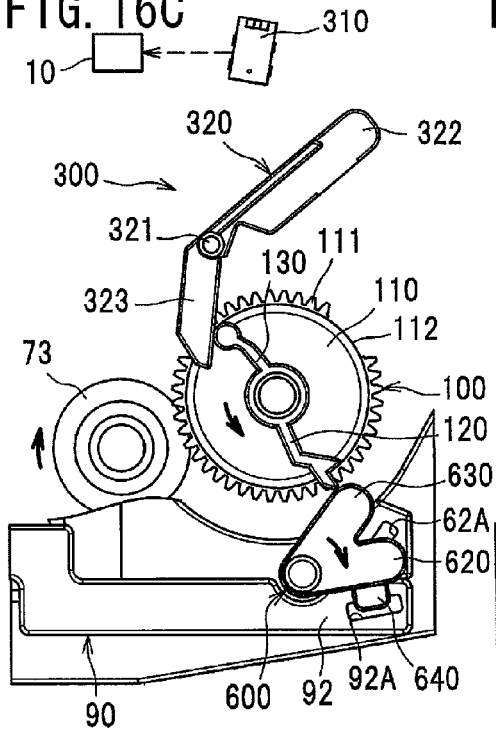

When the sensor gear 100 once again begins to rotate, the first detection part 120 contacts the second arm 630 of the moving member 600, as illustrated in FIG. 16C, and pushes the second arm 630 toward the non-contact position. Accordingly, the moving member 600 is displaced from its second orientation to its third orientation. At this time, the engaging protrusion provided on the engaging part 640 becomes engaged in the second engaging hole 92A formed in the linking member 90, thereby locking the moving member 600 in its third orientation.

Figure 16D:
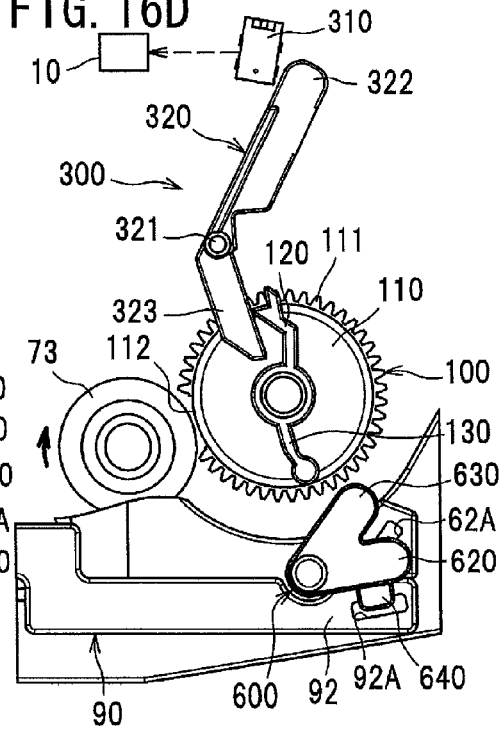

The sensor gear 100 continues rotating until the sensor gear 100 shifts from its transmission position to its non-transmission position shown in FIG. 16D. At this time, the sensor gear 100 comes to a halt with the first detection part 120 in contact with the contact arm 323.

Figure 17:
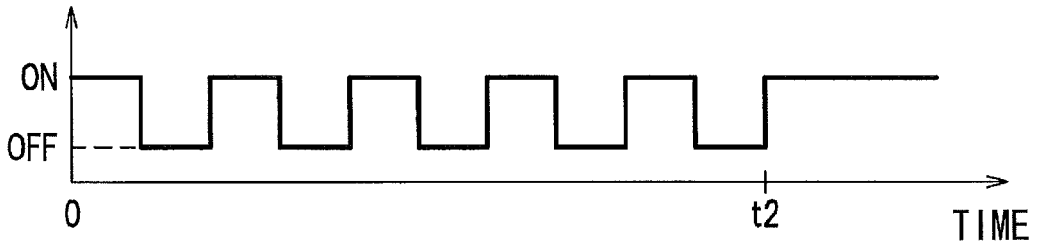
FIG. 17 shows a signal outputted from the photosensor to the control unit for the case in which the developer cartridge and the drum cartridge are both in a new state.

As described above, when both the drum cartridge 6 and developer cartridge 7 are new as in the above example, signal output from the photosensor 310 is halted (switched to its OFF state) five times from the start of the idle rotation operation (time zero) to a predetermined time t2 (the time required for the sensor gear 100 to complete about two and a half rotations, for example), as illustrated in FIG. 17. Based on these signals, the control unit 10 can determine that both the drum cartridge 6 and developer cartridge 7 are in a new state.

When the Discharge Wire has been Cleaned by the Wire Cleaner

Next, the operations of the laser printer 1 will be described for the case in which the drum cartridge 6 is in a used state and the discharge wire 12A of the charger 12 has been cleaned by the wire cleaner 12C. This description also assumes that the developer cartridge 7 is in a new state.

Figure 18A:
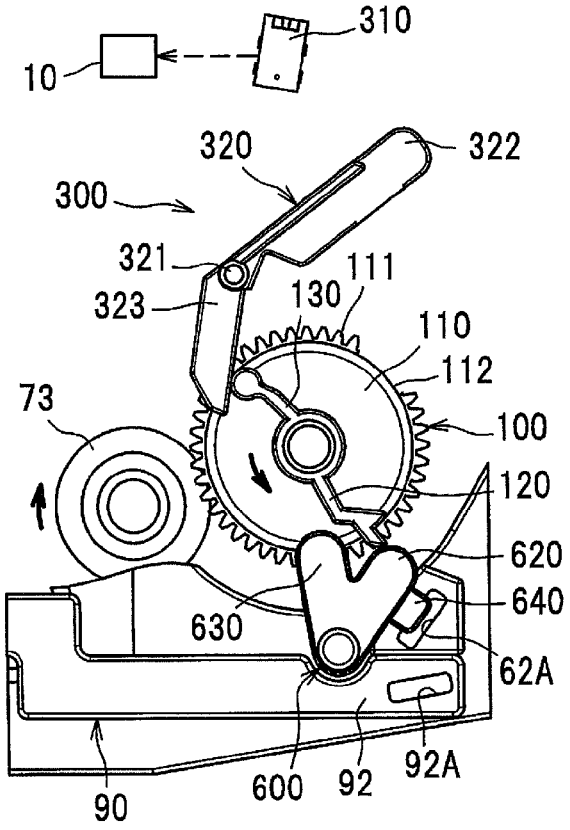
FIG. 18A illustrates the operations of the sensor gear and the moving member for the case in which a wire cleaner has been operated.

Because the drum cartridge 6 is in a used state, the engaging protrusion provided on the engaging part 640 of the moving member 600 is engaged in the second engaging hole 92A of the linking member 90, as illustrated in FIG. 16D. When the wire cleaner 12C is operated, the front end 92 of the linking member 90 moves toward the left side wall 61 of the drum-cartridge frame 60. Consequently, the engaging protrusion on the engaging part 640 is extracted from the second engaging hole 92A, allowing the moving member 600 to pivot counterclockwise in the drawings from the third orientation due to the urging force of the torsion coil spring. As the moving member 600 pivots, the engaging protrusion on the engaging part 640 moves along the left side wall 61 of the drum-cartridge frame 60 and enters the first engaging hole 62A. In other words, the engaging protrusion on the engaging part 640 becomes engaged in the first engaging hole 62A formed in the drum-cartridge frame 60, as illustrated in FIG. 18A. Thus, in association with the movement of the wire cleaner 12C, the second arm 630 is moved from its non-contact position to its contact position and the moving member 600 becomes locked in the second orientation.

When the process cartridge 5 in this state is subsequently mounted in the main casing 2, the laser printer 1 performs the same operations as described for the case in which the drum cartridge 6 and developer cartridge 7 are both in a new state after the second arm 630 has already been moved to the contact position (i.e., beginning from the state shown in FIG. 15D).

Figure 18B:
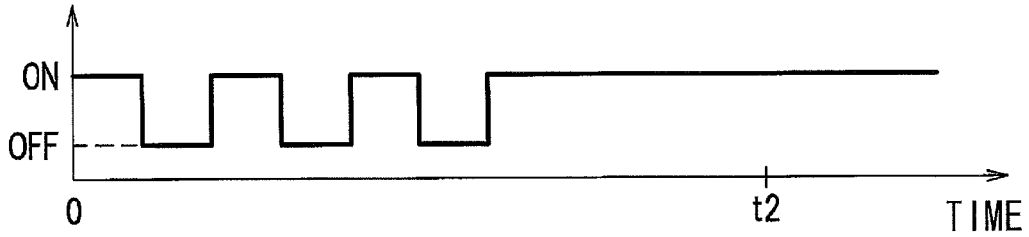
FIG. 18B shows a signal outputted from the photosensor to the control unit for the case in which the wire cleaner has been operated.

When the wire cleaner 12C has cleaned the discharge wire 12A as described above, the signal outputted from the photosensor 310 is halted (switched to the OFF state) three times within the predetermined time t2 after the start of the idle rotation operation as shown in FIG. 18B. Hence, the control unit 10 can determine that the discharge wire 12A has been cleaned based on this signal.

When the Drum Cartridge is New and the Developer Cartridge is Used

Next, the operations performed on the laser printer 1 when the drum cartridge 6 is in a new state and the developer cartridge 7 is in a used state will be described. Because the developer cartridge 7 is in a used state, the sensor gear 100 moves from the non-transmission position to the transmission position when the developer cartridge 7 is mounted on the drum cartridge 6, as described in the first embodiment. When the process cartridge 5 is subsequently mounted in the main casing 2 in this state, the laser printer 1 performs the same operations described for the case in which both the drum cartridge 6 and developer cartridge 7 are in a new state after the first arm 620 of the moving member 600 has moved the sensor gear 100 from the non-transmission position to the transmission position (i.e., beginning from the state shown in FIG. 15C).

Figure 19:
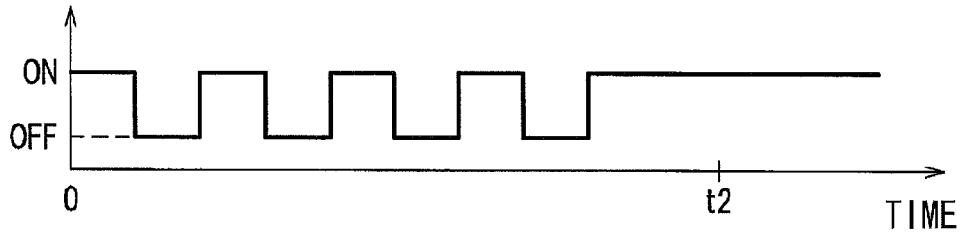
FIG. 19 shows a signal outputted from the photosensor to the control unit for the case in which the developer cartridge is in a used state and the drum cartridge is in a new state.

Thus, when the drum cartridge 6 is in a new state and the developer cartridge 7 is in a used state as described above, the signal outputted from the photosensor 310 is halted (switched to the OFF state) four times within the predetermined time t2 after the start of the idle rotation operation, as illustrated in FIG. 19. Based on this signal, the control unit 10 can therefore determine that the drum cartridge 6 is in a new state and the developer cartridge 7 is in a used state.

When the Drum Cartridge is Used and the Developer Cartridge is New

Next, the operations performed by the laser printer 1 will be described for the case in which the drum cartridge 6 is in a used state and the developer cartridge 7 is in a new state.

Figure 20A:
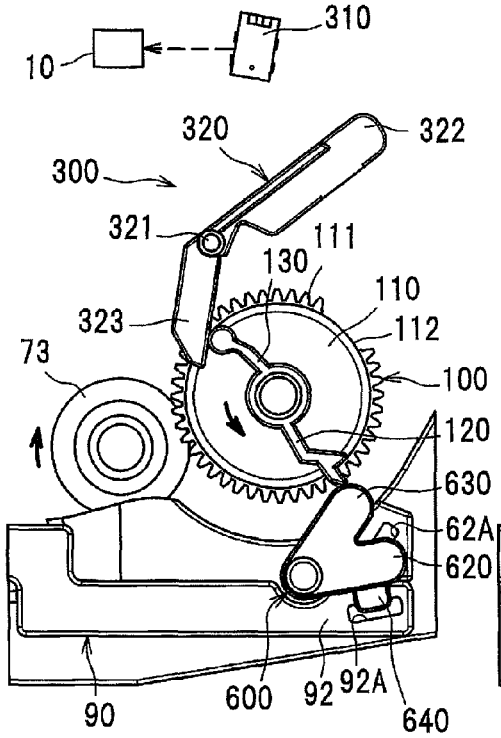
FIGS. 20A-20B illustrate the operations of the sensor gear and the moving member for the case in which the developer cartridge is in a new state and the drum cartridge is in a used state.

When the drum cartridge 6 is in a used state, the moving member 600 is in the third orientation illustrated in FIG. 20A. Thus, both the first and second arms 620 and 630 are disposed outside the paths of the first and second detection parts 120 and 130 provided on the sensor gear 100. When the process cartridge 5 is mounted in the main casing 2, the second detection part 130 contacts the contact arm 323, moving the light-shielding arm 322 into the detection position. Consequently, the photosensor 310 outputs a signal to the control unit 10.

Figure 20B:
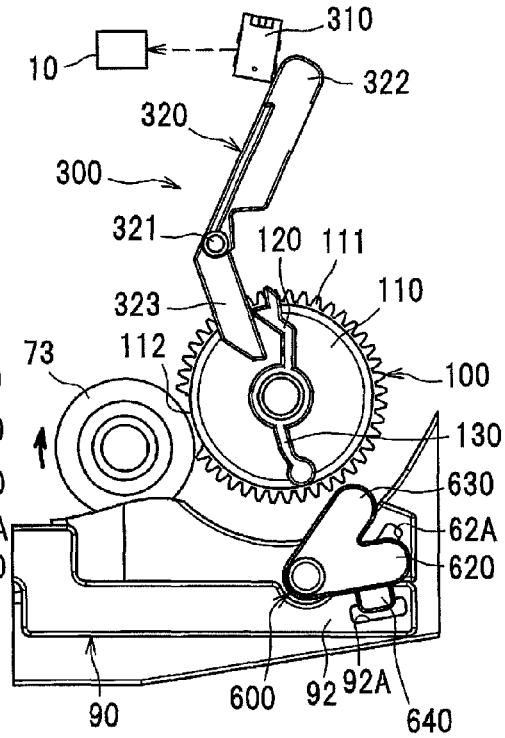

When the idle rotation operation begins, the sensor gear 100 begins rotating. The sensor gear 100 then switches from the transmission position to the non-transmission position shown in FIG. 20B, and comes to a halt.

Figure 20C:
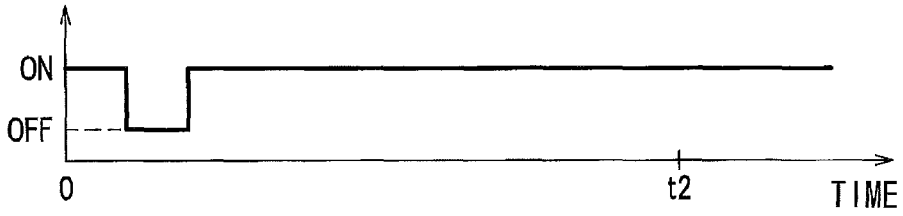
FIG. 20C shows a signal outputted from the photosensor to the control unit for the case in which the developer cartridge is in a new state and the drum cartridge is in a used state.

Thus, when the drum cartridge 6 is in a used state and the developer cartridge 7 is in a new state as described above, the signal outputted from the photosensor 310 is halted (switched to an OFF state) only once within the predetermined time t2 after the start of the idle rotation operation, as illustrated in FIG. 20C. Therefore, the control unit 10 can determine that the drum cartridge 6 is used and the developer cartridge 7 is new based on this signal.

When the Drum Cartridge and Developer Cartridge are Both Used

As in the first embodiment, when the drum cartridge 6 and developer cartridge 7 are both in a used state, the sensor gear 100 does not rotate even from the beginning of the idle rotation operation. Thus, when both the drum cartridge 6 and developer cartridge 7 are in a used state, the signal is continuously outputted (remains in an ON state) from the photo sensor 310 during the predetermined time t2 after the start of the idle rotation operation. Therefore, the control unit 10 can determine that both the drum cartridge 6 and developer cartridge 7 are used based on this signal.

With the process cartridge 5 according to the second embodiment described above, the mechanism for detecting whether the developer cartridge 7 is in a new state (i.e., the sensor gear 100 and sensing mechanism 300) can also be used to detect whether the drum cartridge 6 is in a new state and whether the discharge wire 12A of the charger 12 has been cleaned. With this construction, there is no need to provide detecting means for detecting whether the discharge wire 12A has been cleaned separately from the mechanism for detecting whether the developer cartridge 7 is in a new state, thereby reducing the number of required parts.

While the invention has been described in detail with reference to specific embodiments thereof, it would be apparent to those skilled in the art that many modifications and variations may be made therein without departing from the spirit of the invention, the scope of which is defined by the attached claims.

For example, while the first detection part 120 serves as an example of a contact part provided on the sensor gear 100 in the embodiments described above, a protrusion provided separately from the first detection part 120 may be used as an example of the contact part instead. Similarly, while the second detection part 130 is used as an example of a contacted part provided on the sensor gear 100 in the embodiments, a protrusion provided separately from the second detection part 130 may be used as an example of the contacted part instead.

In the embodiments described above, the toothed portion 111 provided with gear teeth is used as an example of a transmission part on a first rotary body used to transmit a drive force, but the present invention is not limited to this configuration. For example, a rubber belt may be applied to a portion on the peripheral surface of the first rotary body, and the portion of the first rotary body having the rubber belt may serve as an example of the transmission part. With this configuration, a drive force is transmitted by friction generated between the first rotary body and second rotary body when the transmission part of the first rotary body opposes the second rotary body.

While the developer cartridge 7 described in the embodiments is provided with the developing roller 18 and serves as an example of a developer cartridge, the present invention may be applied to a developer cartridge that does not include a developing roller.

The first and second detection parts 120 and 130 constitute the detected parts in the embodiments described above, but the present invention may be applied to a structure that includes only one detected part, or a structure that includes three or more detected parts.

What is claimed is:

1. A cartridge comprising:

a photosensitive body cartridge having a photosensitive body; and a developer cartridge configured to accommodate developer therein and configured so as to be attachable to and detachable from the photosensitive body cartridge;

the developer cartridge comprising:

a first rotary body rotatably supported by the developer cartridge and having at least one detected part configured to be detected by a detecting unit that is provided outside the cartridge; and a second rotary body rotatably supported by the developer cartridge and configured to transmit, to the first rotary body, drive force inputted from an outside of the cartridge, the first rotary body including:

a transmission part that is configured such that when the transmission part is disposed opposite the second rotary body, the transmission part brings the first rotary body into a state that the first rotary body is able to receive drive force from the second rotary body, thereby causing the first rotary body to rotate; and a non-transmission part that is configured such that when the non-transmission part is disposed opposite the second rotary body, the non-transmission part brings the first rotary body into a state that the first rotary body is unable to receive drive force from the second rotary body, the first rotary body being configured to rotate between a first position, in which the transmission part is disposed opposite the second rotary body, and a second position, in which the non-transmission part is disposed opposite the second rotary body, the first rotary body reaching the second position after having rotated by a prescribed amount from the first position, the first rotary body including a contacted part, the photosensitive body cartridge including a moving member configured to move between a third position, in which the moving member is able to contact the contacted part, and a fourth position, in which the moving member is unable to contact the contacted part, the moving member being configured such that when the moving member is in the third position, the moving member contacts the contacted part of the first rotary body disposed in the second position, causing the first rotary body to rotate to the first position, and the moving member thereafter moves to the fourth position in association with rotation of the first rotary body.

2. The cartridge according to claim 1, wherein the first rotary body is disposed in the first position when the developer cartridge is in a new state, and wherein the moving member is disposed in the third position when the photosensitive body cartridge is in a new state.

3. The cartridge according to claim 1, wherein the first rotary body includes a contact part that is configured to contact the moving member to move the moving member from the third position to the fourth position while the first rotary body rotates from the first position to the second position after having been contacted by the moving member to rotate from the second position to the first position.

4. The cartridge according to claim 3, wherein when the developer cartridge is in a new state, the contact part is positioned downstream in a rotating direction of the first rotary body from the moving member which is disposed in the third position, and wherein when the developer cartridge is in a new state, the contacted part is disposed upstream in the rotating direction from the moving member which is disposed in the third position.

5. The cartridge according to claim 3, wherein the contact part is one of the at least one detected part.

6. The cartridge according to claim 3, wherein the contacted part is one of the at least one detected part.

7. The cartridge according to claim 3, wherein the at least one detected part includes a first detected part and a second detected part, the contact part is the first detected part, and the contacted part is the second detected part.

8. The cartridge according to claim 7, wherein each of the first detected part and the second detected part is a protrusion that projects from the first rotary body in a direction along a rotational axis of the first rotary body, wherein when the moving member is in the third position, part of the moving member is positioned within moving paths of the first detected part and the second detected part, and wherein when the moving member is in the fourth position, an entire part of the moving member is positioned outside the moving paths of the first detected part and the second detected part.

9. The cartridge according to claim 8, wherein the moving member is configured to move from the third position and then move back to the third position when the second detected part contacts the moving member from an upstream side of the moving member in a rotating direction of the first rotary body while the first rotary body rotates from the first position to the second position.

10. The cartridge according to claim 9, wherein the moving member is urged toward the third position.

11. The cartridge according to claim 8, wherein the photosensitive body cartridge includes a locking mechanism configured to lock the moving member in the fourth position when the moving member has moved to the fourth position from the third position.

12. The cartridge according to claim 8, wherein the first detected part extends further outward in a radial direction of the first rotary body than the second detected part.

13. The cartridge according to claim 1, wherein the moving member is pivotably supported by a casing of the photosensitive body cartridge and is configured to move from the third position to the fourth position by pivoting relative to the casing.

14. The cartridge according to claim 1, wherein the photosensitive body cartridge includes: a charging unit having a discharge wire; and a wire cleaner configured to move to clean the discharge wire, wherein the moving member includes a first moving member and a second moving member configured to move together with the first moving member, and wherein the second moving member is configured to move to the third position when the first moving member moves from the third position to the fourth position, and to move from the fourth position back to the third position in association with movement of the wire cleaner after having moved from the third position to the fourth position.

15. A drum cartridge for detachably accommodating a developer cartridge therein, the developer cartridge including a drive-force input member configured to receive drive force from an outside of the developer cartridge and a detected body configured to be detected by an external detecting device that is provided outside the developer cartridge, the detected body being configured to rotate about a prescribed rotational axis upon receipt of drive force transmitted from the drive-force input member, the drum cartridge comprising:

a photosensitive drum;

a housing configured to detachably accommodate a developer cartridge therein; and a moving member configured to move relative to the housing, the moving member being configured to move the detected body to a first position, in which drive force is transmitted from the drive-force input member to the detected body, from a second position, in which transmission of drive force from the drive-force input member to the detected body is blocked, by contacting the detected body disposed in the second position.

16. The drum cartridge according to claim 15, wherein the moving member is configured to move in association with rotation of the detected body from a third position, at which the moving member is positioned within a rotating path of the detected body, to a fourth position, at which the moving member is positioned outside the rotating path of the detected body.

17. The drum cartridge according to claim 16, wherein the moving member is configured to move from the third position to the fourth position by rotating about a rotational axis that extends along the prescribed rotational axis when the developer cartridge is accommodated in the housing.

18. The drum cartridge according to claim 17, further comprising a locking mechanism configured to lock the moving member in the fourth position.

19. A process cartridge comprising:

a developer cartridge; and a drum cartridge having a photosensitive drum and a housing configured to detachably accommodate the developer cartridge therein, the developer cartridge including:

a drive-force input member configured to receive drive force from an outside of the process cartridge;

a detected body configured to be detected by an external detecting device that is provided outside the process cartridge, the detected body being configured to move between a first position, in which drive force is transmitted from the drive-force input member to the detected body, and a second position, in which transmission of drive force from the drive-force input member to the detected body is blocked, the detected body being configured to rotate about a prescribed rotational axis upon receipt of drive force transmitted from the drive-force input member; and a developing roller configured to supply developer to the photosensitive drum, the drum cartridge including a moving member configured to move relative to the housing, the moving member being positioned within a rotating path of the detected body, the moving member being configured to contact the detected body in the second position, to thereby move the detected body from the second position to the first position.

* * * * *